US011414835B2

(12) United States Patent
Toyama et al.

(10) Patent No.: US 11,414,835 B2
(45) Date of Patent: Aug. 16, 2022

(54) WORKING MACHINE

(71) Applicant: KUBOTA CORPORATION, Osaka (JP)

(72) Inventors: Masahiro Toyama, Osaka (JP); Ryuki Nishimoto, Osaka (JP); Yuji Fukuda, Osaka (JP); Kohei Nagao, Osaka (JP); Ryota Hamamoto, Osaka (JP); Hiroaki Nakagawa, Osaka (JP)

(73) Assignee: KUBOTA CORPORATION, Osaka (JP)

( * ) Notice: Subject to any disclaimer, the term of this patent is extended or adjusted under 35 U.S.C. 154(b) by 0 days.

(21) Appl. No.: 17/076,282

(22) Filed: Oct. 21, 2020

(65) Prior Publication Data

US 2021/0123212 A1 Apr. 29, 2021

(30) Foreign Application Priority Data

Oct. 28, 2019 (JP) ..... JP2019-195520
Oct. 28, 2019 (JP) ..... JP2019-195521

(51) Int. Cl.

| | |
|---|---|
| ***E02F 9/22*** | (2006.01) |
| ***E02F 9/20*** | (2006.01) |
| *E02F 3/42* | (2006.01) |
| *E02F 3/34* | (2006.01) |

(52) U.S. Cl.

CPC ..... *E02F 9/2228* (2013.01); *E02F 9/2004* (2013.01); *E02F 9/2267* (2013.01); *E02F 3/3414* (2013.01); *E02F 3/422* (2013.01); *E02F 9/2285* (2013.01); *E02F 9/2292* (2013.01); *E02F 9/2296* (2013.01)

(58) Field of Classification Search

CPC ..... E02F 9/2207; E02F 9/2004; E02F 9/2228; E02F 9/2267; F15B 2211/6346

See application file for complete search history.

(56) References Cited

U.S. PATENT DOCUMENTS

| | | | | |
|---|---|---|---|---|
| 6,725,105 | B2 | 4/2004 | Francis et al. | |
| 6,854,554 | B2 | 2/2005 | Brandt et al. | |
| 9,085,440 | B2 * | 7/2015 | Choi | E02F 9/2203 |
| 2005/0207897 | A1 * | 9/2005 | Kim | E02F 9/2062 417/1 |
| 2011/0318155 | A1 * | 12/2011 | Okamura | E02F 9/2203 414/685 |

* cited by examiner

*Primary Examiner* — Abiy Teka
(74) *Attorney, Agent, or Firm* — Greenblum & Bernstein, P.L.C.

(57) ABSTRACT

A working machine includes a hydraulic device, an operation valve to supply operation fluid to operate the hydraulic device and to vary the operation fluid to be supplied to the hydraulic device, an operation device having an operation member supported swingably, the operation device being configured to output an operation signal in accordance with an operation amount of the operation member, and a controller including a swing calculator to calculate an evaluation value representing a degree of swinging of the operation member, and a control signal generator to generate a control signal based on the evaluation value and the operation signal.

18 Claims, 11 Drawing Sheets

WORKING MACHINE

CROSS-REFERENCE TO RELATED APPLICATIONS

The present application claims priority under 35 U.S.C. § 119 to Japanese Patent Application No. P2019-195520, filed Oct. 28, 2019 and to Japanese Patent Application No. P2019-195521, filed Oct. 28, 2019. The contents of these applications are incorporated herein by reference in their entirety.

BACKGROUND OF THE INVENTION

Field of the Invention

The present invention relates to a working machine.

Description of Related Art

The technology relating to the treatment of an electrically operated device in a working machine is disclosed in U.S. Pat. Nos. 6,854,554 and 6,725,105.

In U.S. Pat. No. 6,854,554, a filter processing is performed on an operation signal output from an electric operation device by passing a low-pass filter, and then the filtered signal is used to operate the solenoid valve. In U.S. Pat. No. 6,725,105, the relation between the operation signal output from the electric operation device and the displacement of the spool is switched.

SUMMARY OF THE INVENTION

A working machine includes a hydraulic device, an operation valve to supply operation fluid to operate the hydraulic device and to vary the operation fluid to be supplied to the hydraulic device, an operation device having an operation member supported swingably, the operation device being configured to output an operation signal in accordance with an operation amount of the operation member, and a controller including a swing calculator to calculate an evaluation value representing a degree of swinging of the operation member, and a control signal generator to generate a control signal based on the evaluation value and the operation signal.

A working machine includes a hydraulic device, an operation valve to supply operation fluid to operate the hydraulic device and to vary the operation fluid to be supplied to the hydraulic device, an operation device having an operation member supported swingably, the operation device being configured to output an operation signal in accordance with an operation amount of the operation member, a controller including a control signal generator to generate a control signal to control the operation valve based on the operation signal, a swing calculator to calculate an evaluation value representing a degree of swinging of the operation member based on the operation signal, a filter to remove a predetermined frequency component from either the operation signal or the control signal, and a signal judgment analyzer to judge whether to allow the filter to remove the predetermined frequency component from either the operation signal or the control signal based on the evaluation value calculated by the swing calculator.

DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 1:
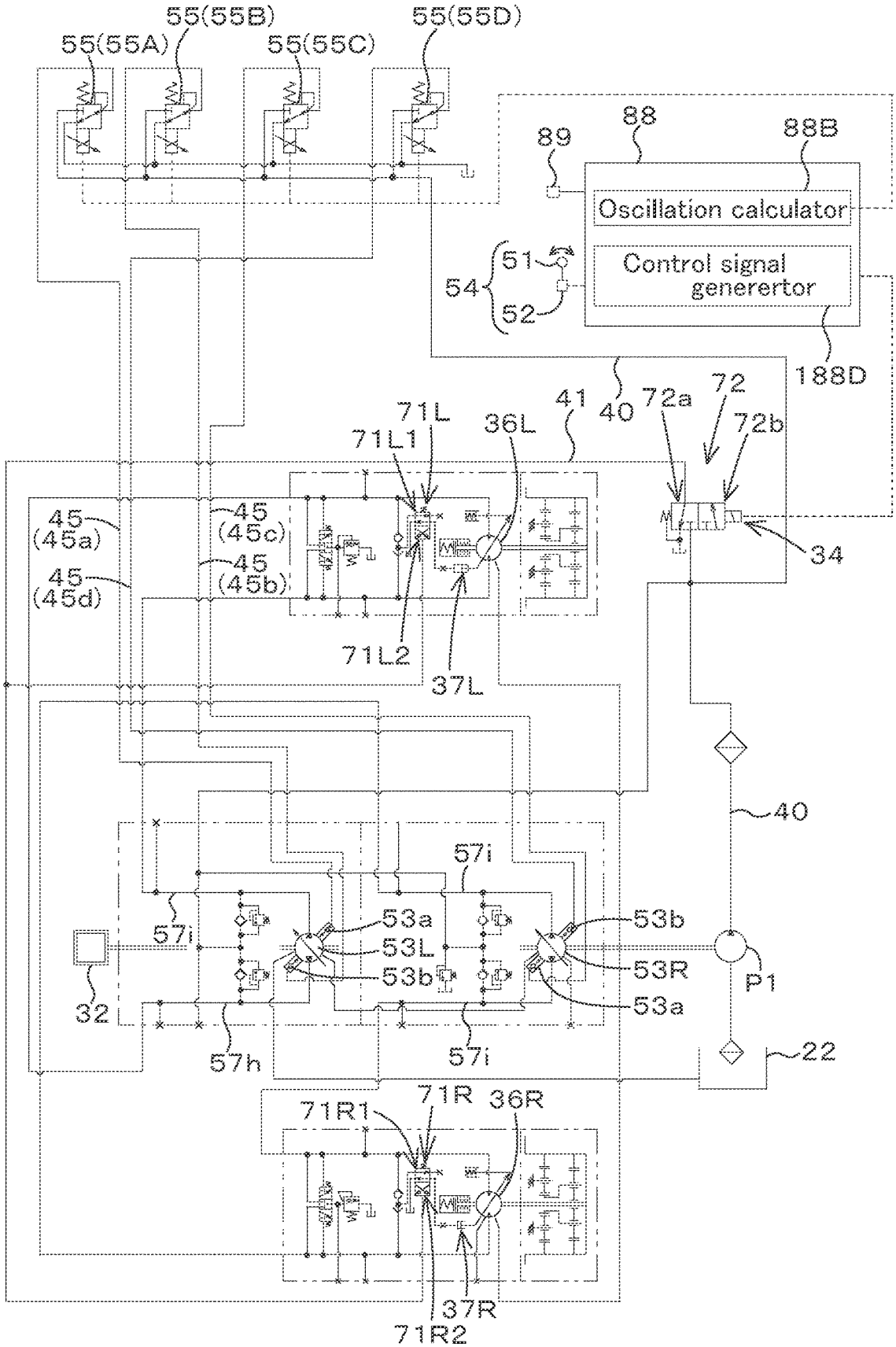
FIG. 1 is a schematic view of a traveling hydraulic system for a working machine.

The embodiments of the present invention will now be described with reference to the accompanying drawings, wherein like reference numerals designate corresponding or identical elements throughout the various drawings. The drawings are to be viewed in an orientation in which the reference numerals are viewed correctly.

An preferred embodiment of a working machine according to the present invention will be described below with reference to the drawings as appropriate.

First Embodiment

Figure 6A:
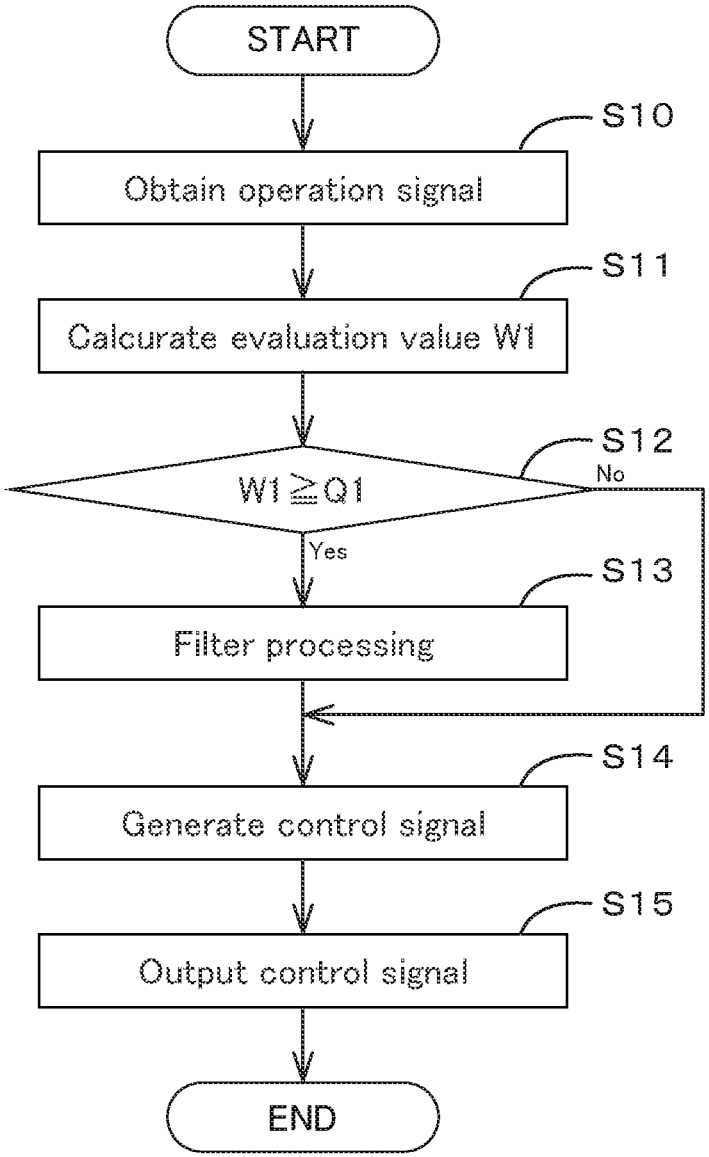
FIG. 6A is a flowchart showing processing of a controller device.
Figure 6B:
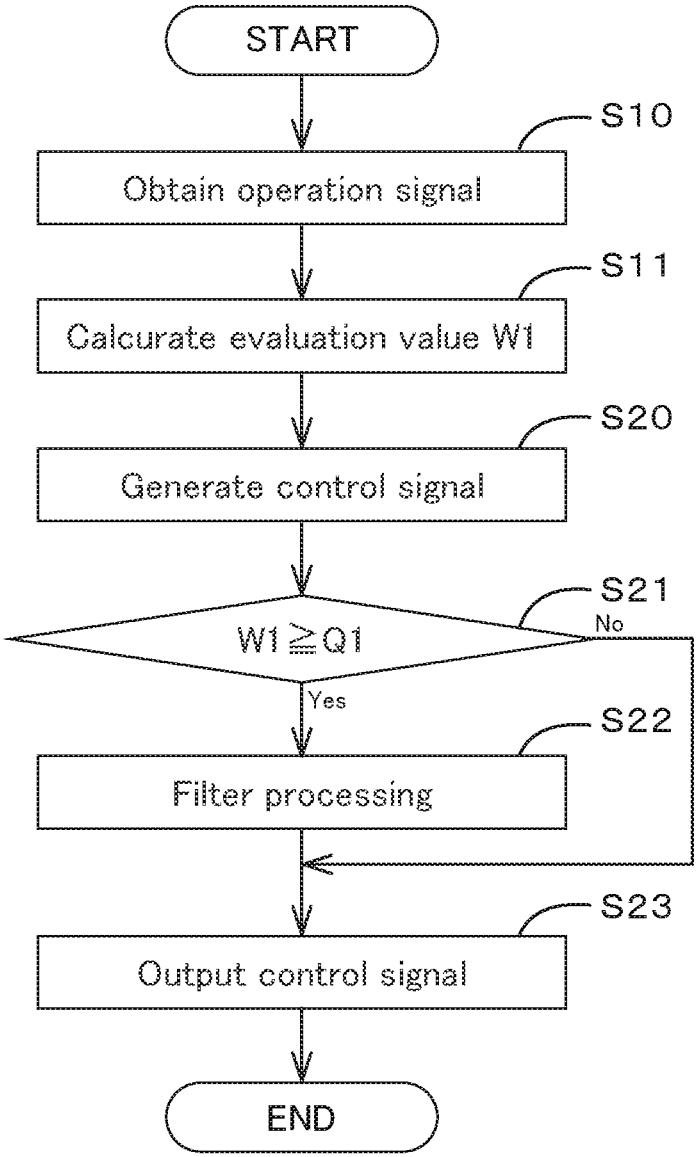
FIG. 6B is a flowchart showing processing of a controller device different from FIG. 6A.
Figure 7:
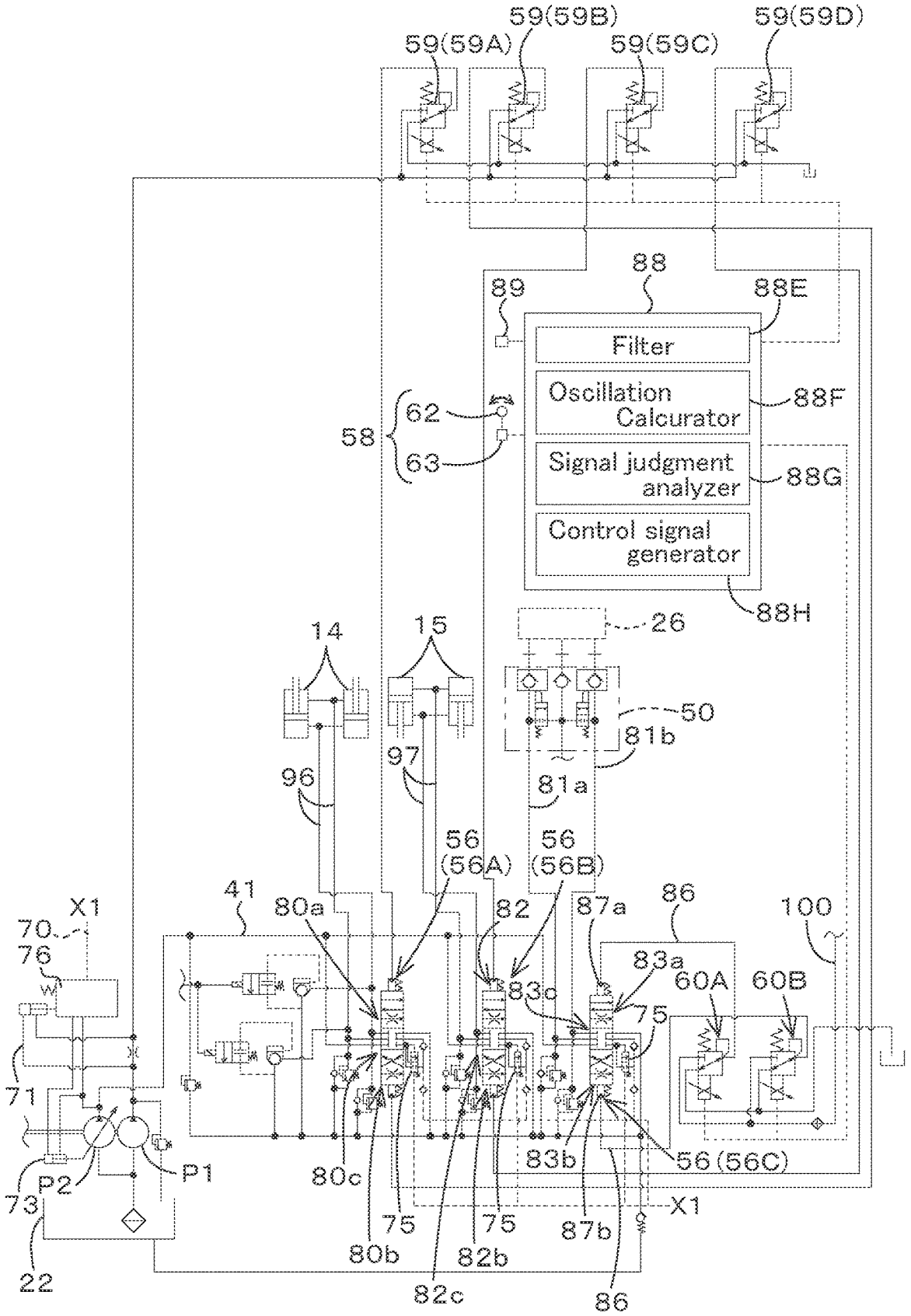
FIG. 7 is a schematic view showing a working hydraulic system for a working machine.
Figure 8:
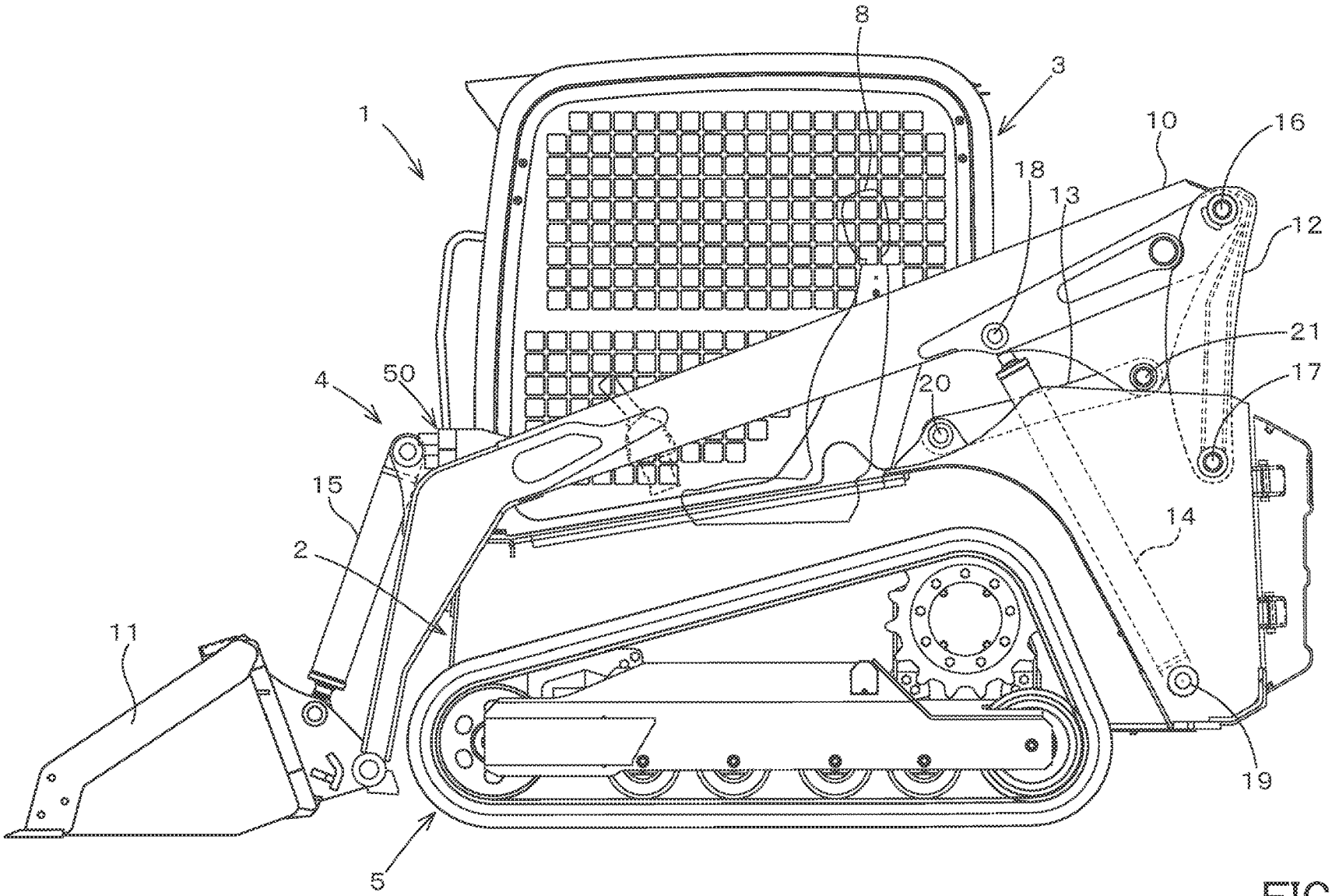
FIG. 8 is a side view of a track loader as an example of a working machine.

FIG. 6 shows a side view of a working machine in accordance with the present invention. In FIG. 6, a compact track loader is shown as an example of a working machine. However, the working machine of the present invention is not limited to a compact track loader and may be other types of loader working machine, such as a skid steer loader, for example. It may also be a working machine other than a loader working machine.

As shown in FIG. 6, the working machine 1 is provided with a machine body 2, a cabin 3, a working device 4, and a pair of traveling devices 5L and 5R. In an embodiment of the present invention, the front side (the left side of FIG. 6) of the driver seated in the operator seat 8 of the working machine 1 is described as the front, the rear side (the right side of FIG. 6) of the driver is described as the rear, the left side (the front surface side of FIG. 6) of the driver is described as the left, and the right side (the back surface side of FIG. 6) of the driver is described as the right.

The horizontal direction, which is orthogonal to the front-rear direction, is explained as the width direction of the machine body. The direction from the center to the right or left of machine body 2 is explained as a machine outward direction. In other words, the machine outward direction is the direction of the machine body width and separating away from the machine body 2. The opposite direction from the machine outward direction is described as a machine inward direction.

In other words, the machine inward direction is the direction of the machine body width, which is the direction of approaching the machine body 2.

The cabin 3 is mounted on machine body 2. The cabin 3 is provided with an operator seat 8. The working machine 4 is mounted on the machine body 2. A pair of traveling devices 5L and 5R are provided on the outside of the machine body 2. A prime mover 32 is mounted at the rear portion inside the machine body 2.

The working machine 4 has a boom 10, a working tool 11, a lift link 12, a control link 13, a boom cylinder 14, and a working tool cylinder 15.

The working tool 11 is, for example, a bucket, the bucket 11 being provided at the end (front end) of the boom 10 for vertical pivoting. The lift link 12 and the control link 13 support the base (rear) of the boom 10 so that the boom 10 can pivot up and down freely. The boom cylinder 14 raises and lowers the boom 10 by extending and shortening the boom cylinder 14. The working tool cylinder 15 pivots the bucket 11 by extending and shortening.

The front portions of each boom 10 on the left and right side are connected to each other by a deformed connecting pipe. The base (rear) of each boom 10 is connected to each other by a circular connecting pipe.

The lift links 12, control links 13 and boom cylinders 14 are provided on the left and right sides of the machine body 2, respectively, corresponding to each boom 10 on the left side and the right side.

The lift link 12 is provided vertically at the rear portion of the base of each boom 10. The upper portion (one end side) of the lift link 12 is pivoted freely around a horizontal axis via a pivot shaft 16 near the rear portion of the base of each boom 10.

The lower portion (the other end side) of the lift link 12 is pivoted freely around a horizontal axis via the pivot shaft 17 near the rear portion of the body 2. The pivot shaft 17 is provided below the pivot shaft 16.

The upper portion of the boom cylinder 14 is pivoted freely around a horizontal axis via a pivot shaft 18. The pivot shaft 18 is the base of each boom 10 and is located at the front of the base. The lower portion of the boom cylinder 14 is pivoted freely around the lateral axis via the pivot shaft 19. The pivot shaft 19 is located near the bottom of the rear portion of the machine body 2 and below the pivot shaft 18.

A control link 13 is provided in front portion of the lift link 12. One end of the control link 13 is rotatably pivoted around a horizontal axis via a pivot shaft 20. The pivot shaft 20 is located on the machine body 2, corresponding to the front of the lift link 12. The other end of the control link 13 is pivoted rotatably around the lateral axis via the pivot shaft 21. The pivot shaft 21 is a boom 10, which is located forward of and above the pivot shaft 17.

By extending and shortening the boom cylinder 14, each boom 10 pivots up and down around the pivot shaft 16 while the base of each boom 10 is supported by the lift link 12 and the control link 13, and the tip portion of each boom 10 is raised and lowered.

The control link 13 pivots up and down around the pivot axis 20 with the vertical oscillation of each boom 10. The lift link 12 pivots back and forth around the pivot axis 17 with the vertical pivoting of the control link 13.

The front of the boom 10 can be fitted with another working tool in place of the bucket 11. Another working tool is, for example, a hydraulic crusher, a hydraulic breaker, an angle broom, an earth auger, a pallet fork, a sweeper, a mower, a snow blower and other attachments (auxiliary attachments).

A connecting member 50 is provided at the front of the boom 10 on the left side. The connecting member 50 is a device that connects the hydraulic device on the auxiliary attachment to a pipe or other first pipe material on the boom 10.

Specifically, a first tube material can be connected to one end of the connecting member 50, and a second tube material connected to the hydraulic device of the auxiliary attachment can be connected to the other end. As a result, the hydraulic fluid flowing through the first tube material passes through the second tube material and is supplied to the hydraulic device.

The working tool cylinders 15 are located near the front of each boom 10, respectively. By extending and shortening the working tool cylinders 15, the bucket 11 is pivoted.

Of the pair of traveling devices 5L and 5R, the traveling device 5L is provided on the left side of the machine body 2 and the traveling device 5R is provided on the right side of the machine body 2. The pair of traveling devices 5L and 5R are of the crawler type (including the semi-crawler type) in this embodiment.

A wheel-type traveling device having a front wheel and a rear wheel may be employed. Hereinafter, for convenience of explanation, the traveling device 5L may be referred to as the left traveling device 5L and the traveling device 5R may be referred to as the right traveling device 5R.

The prime mover 32 is a diesel engine, an internal combustion engine such as a gasoline engine, an electric motor, and the like. In this embodiment, the prime mover 32 is a diesel engine, but is not limited thereto.

Next, the hydraulic system of the traveling system for the working machine will be explained.

As shown in FIG. 1, the hydraulic system of the traveling system for the working machine is provided with a first hydraulic pump P1. The first hydraulic pump P1 is a pump driven by the power of the prime mover 32 and is constituted of a gear pump of a constant displacement type (a fixed displacement type). The first hydraulic pump P1 is capable of outputting hydraulic fluid stored in the hydraulic fluid tank 22.

In particular, the first hydraulic pump P1 outputs hydraulic fluid that is mainly used for control. Of the hydraulic fluid output from the first hydraulic pump P1, the hydraulic fluid used for control may be referred to as the pilot fluid, and the pressure of the pilot fluid may be referred to as the pilot pressure.

The second hydraulic pump P2 is a pump driven by the power of the prime mover 32 and comprises a gear pump of a constant displacement type. The second hydraulic pump P2 is capable of outputting hydraulic fluid stored in the hydraulic fluid tank 22 and supplies hydraulic fluid, for example, to the fluid line of the working system.

For example, the second hydraulic pump P2 supplies hydraulic fluid to the control valve (flow control valve) that controls the boom cylinder 14 that operates the boom 10, the working tool cylinder 15 that operates the bucket, and the auxiliary hydraulic actuator that operates the auxiliary hydraulic actuator.

The hydraulic system of the traveling system for the working machine is provided with a pair of traveling motors 36L and 36R and a pair of traveling pumps 53L and 53R. The pair of traveling motors 36L and 36R are motors that transmit power to a pair of traveling devices 5L and 5R.

Of the pair of traveling motors 36L and 36R, one of the traveling motors 36L transmits the power of rotation to the traveling device (left traveling device) 5L and the other traveling motor 36R transmits the power of rotation to the traveling device (right traveling device) 5R.

The pair of traveling pumps 53L and 53R are pumps driven by the power of the prime mover 32, for example, a swash plate type variable displacement axial pump. The pair of traveling pumps 53L and 53R supply hydraulic fluid to each of the pair of traveling motors 36L and 36R as they are driven.

Of the pair of traveling pumps 53L and 53R, one traveling pump 53L supplies hydraulic fluid to the traveling pump 53L and the other traveling pump 53R supplies hydraulic fluid to the traveling pump 53R.

For convenience of explanation, the traveling pump 53L may be referred to as the left traveling pump 53L, the traveling pump 53R may be referred to as the right traveling pump 53R, the traveling motor 36L may be referred to as the left traveling motor 36L, and the traveling motor 36R may be referred to as the right traveling motor 36R.

The left traveling pump 33L and the right traveling pump 33R have a forward receiver portion 53*a* and a backward receiver portion 53*b* on which the pressure of the hydraulic fluid (pilot pressure) from the first hydraulic pump P1 (pilot fluid) acts.

The angle of the swash plate is changed by the pilot pressure acting on the pressure receiver portions 53*a* and 53*b*. By changing the angle of the swash plate, the output of the left traveling pump 53L and the right traveling pump 53R (output amount of hydraulic fluid) and the direction of discharge of hydraulic fluid can be changed.

The left traveling pump 53L is connected to the left traveling motor 36L by means of the connecting fluid line 57*h*, and the hydraulic fluid output by the left traveling pump 53L is supplied to the left traveling motor 36L. The right-hand traveling pump 53R is connected to the right-hand traveling motor 36R by means of the connecting fluid line 57*i*, and the hydraulic fluid output by the right-hand traveling pump 53R is supplied to the right-hand traveling motor 36R.

The left traveling motor 36L can be rotated by the hydraulic fluid output from the left traveling pump 33L, and the revolutions speed (number of revolutions) can be changed according to the flow rate of the hydraulic fluid. A swash plate switching cylinder 37L is connected to the left traveling motor 36L. The swash plate switching cylinder 37L can also be extended or shortened to one side or the other to change the revolutions speed (number of revolutions) of the left traveling motor 36L.

That is, when the swash plate switching cylinder 37L is shortened, the speed of the left traveling motor 36L is set to a low speed (first speed). When the swash plate switching cylinder 37L is extended, the speed of the left traveling motor 36L is set to a high speed (second speed). In other words, the speed of the left traveling motor 36L can be changed between the first speed, which is on the low side, and the second speed, which is on the high side.

The right traveling motor 36R can be rotated by the hydraulic fluid output from the right traveling pump 33R, and the revolutions speed (number of revolutions) can be changed according to the flow rate of the hydraulic fluid. A swash plate switching cylinder 37R is connected to the right traveling motor 36R. The swash plate switching cylinder 37R can also be extended or shortened to one side or the other to change the revolutions speed (number of revolutions) of the right traveling motor 36R.

That is, when the swash plate switching cylinder 37R is shortened, the speed of the right traveling motor 36R is set to a low speed (first speed), and when the swash plate switching cylinder 37R is extended, the speed of the right traveling motor 36R is set to a high speed (second speed). In other words, the number of revolutions of the right traveling motor 36R can be changed between the first speed, which is on the low side, and the second speed, which is on the high side.

As shown in FIG. 1, the hydraulic system of the traveling system for the working machine is provided with a traveling switching valve 34. The raveling switch valve 34 is switchable between a first state, in which the rotational speed (number of revolutions) of the traveling motor (left traveling motor 36L, right traveling motor 36R) is set to a first speed, and a second state, in which the speed is set to a second speed. The traveling switching valve 34 has a first switching valve 71L, 71R, and a second switching valve 72.

The first switching valve 71L is a two-position switching valve connected via a fluid circuit to the swash plate switching cylinder 37L of the left traveling motor 36L, which switches to the first position 71L1 and the second position 71L2. The first switching valve 71L shortens the swash plate switching cylinder 37L in the first position 71L1, and extends the swash plate switching cylinder 37L in the second position 71L2.

The first switching valve 71R is a two-position switching valve connected via a fluid circuit to the swash plate switching cylinder 37R of the right traveling motor 36R, which switches to the first position 71R1 and the second position 71R2. The first switching valve 71R contracts the swash plate switching cylinder 37R in the first position 71R1, and extends the swash plate switching cylinder 37R in the second position 71R2.

The second switching valve 72 is a solenoid valve that switches the first switching valve 71L and the first switching valve 71R, and is a two-position switching valve that can be switched between the first position 72A and the second position 72B by magnetization. The second switching valve 72, the first switching valve 71L and the first switching valve 71R are connected by the discharge fluid line 41.

The second switching valve 72 switches the first switching valve 71L and the first switching valve 71R to the first position 71L1 and 71R1 when the first position 72A is the first position 72. The second switching valve 72 switches the first switching valve 71L and the first switching valve 71R to the second position 71L2, 71R2 when the second position 72B is in the second position 72.

In other words, when the second switching valve 72 is in the first position 72*a*, the first switching valve 71L is in the first position 71L1, and the first switching valve 71R is in the first position 71R1, the travel switching valve 34 is in the first state, and the revolutions speed of the travel motor (left traveling motor 36L, right traveling motor 36R) is set to the first speed.

When the second switching valve 72 is in the second position 72*b*, the first switching valve 71L is in the second position 71L2, and the first switching valve 71R is in the second position 71R2, the traveling switching valve 34 is in the second state and the revolutions speed of the traveling motor (left traveling motor 36L, right traveling motor 36R) is set to the second speed.

Thus, the traveling motor (left traveling motor 36L and right traveling motor 36R) can be switched between a first speed, which is on the low speed side, and a second speed, which is on the high speed side, by the traveling switching valve 34.

As shown in FIG. 1, the working machine 1 is provided with an operation device (traveling operation device) 54 and a controller device 88. The operation device 54 is a device for operating the traveling pumps (left traveling pump 53L and right traveling pump 53R), and the angle of the swash plate of the traveling pump (swash plate angle) can be changed. The operation device 54 includes a traveling operation member 51 and a detector sensor 52 capable of detecting an amount of operation of the traveling operation member 51.

The traveling operation member 51 is an operation lever supported by the operation valve 55 and pivoted in the left and right (in the width direction of the machine body) or front-rear directions. That is, the traveling operation member 51 is operable from the neutral position to the right and to the left, as well as forward and backward from the neutral position with respect to the neutral position.

In other words, the traveling operation member 51 can pivot in at least four directions with respect to the neutral position. For convenience of explanation, the forward and rearward bi-directional direction, that is, the front-rear direction, is referred to as the first direction. The right and left bi-directional direction, that is, the left-right direction (the machine width direction) is sometimes referred to as the second direction.

The detector sensor 52 is a sensor for detecting the amount of operation of the traveling operation member 51 from the neutral position. The detector sensor 52 is capable of detecting an operation amount (forward operation amount) when the traveling operation member 51 is operated forwardly from the neutral position, and is capable of detecting an operation amount (backward operation amount) when the traveling operation member 51 is operated backwardly from the neutral position. The detector sensor 52 is capable of detecting an operation amount (leftward operation amount) when the traveling operation member 51 is operated leftward from the neutral position, and is capable of detecting an operation amount (rightward operation amount) when the traveling operation member 51 is operated rightward from the neutral position.

Figure 2:
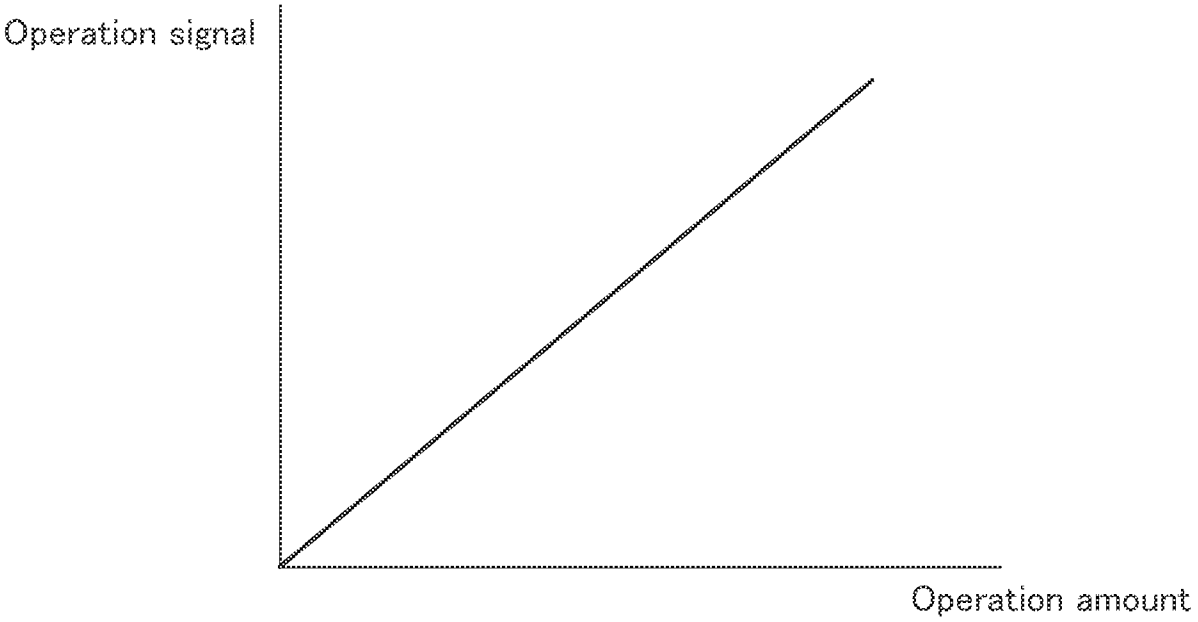
FIG. 2 is a view of an example of a relation between an operation amount and an operation signal.

As shown in FIG. 2, the detector sensor 52 outputs an operation signal to the controller device 88 in accordance with the amount of operation of the traveling operation member 51 (the forward operation amount, the rearward operation amount, the leftward operation amount, and the rightward operation amount). That is, the detector sensor 52 gradually increases the operation signal as the operation amount increases.

In other words, the detector sensor 52 outputs an operation signal proportional to the amount of operation. When the traveling operation member 51 is in the neutral position, that is, the operation amount is zero, the operation signal corresponding to the neutral position is zero, for example, the voltage value is zero.

As shown in FIG. 1, the hydraulic system of the traveling system of the working machine includes a plurality of operation valves 55. The plurality of operation valves 55 are solenoid valves whose opening is changed by electricity and are actuated in response to the rocking of the traveling operation member 51, that is, in response to a control signal generated by the controller device 88 based on an operating signal.

The plurality of operation valves 55 are connected to a discharge fluid line 40, and hydraulic fluid (pilot fluid) from hydraulic pump P1 (pilot fluid) can be supplied through the discharge fluid line 40. The plurality of operation valves 55 are an operation valve 55A, an operation valve 55B, an operation valve 55C and an operation valve 55D.

In the actuator valve 55A, the pressure of the output hydraulic fluid changes when the traveling operation member 51 is pivoted forward (one side) in the front-back direction (first direction) (when operated forward). For the operation valve 55B, the pressure of the hydraulic fluid changes when the traveling operation member 51 is pivoted backward (the other side) in the forward and backward (first) direction (rearward operation).

In the left-right direction (second direction), in the operation valve 55C, the pressure of the output hydraulic fluid changes when the traveling operation member 51 is pivoted to the right (one side) (when operated to the right). For the operation valve 55D, the pressure of the output hydraulic fluid changes when the traveling operation member 51 is pivoted to the left (other direction) in the left (second) direction (when operated to the left).

A plurality of operation valves 55 and the traveling pumps (left traveling pump 53L and right traveling pump 53R) are connected to each other by a traveling fluid circuit 45.

The traveling fluid line 45 has a first traveling fluid line 45*a*, a second traveling fluid line 45*b*, a third traveling fluid line 45*c*, a fourth traveling fluid line 45*d*, and a fifth traveling fluid line 45*e*.

A first traveling fluid line 45*a* is a fluid line connected to the pressure receiver portion 53*a* of the traveling pump 53L for forward motion. A second travel fluid line 45*b* is connected to the backward pressure receiver portion 53*b* of the traveling pump 53L. A third traveling fluid line 45*c* is a fluid line connected to the forward receiver portion 53*a* of the traveling pump 53R.

The fourth traveling fluid line 45*d* is a fluid line connected to the rearward receiver portion 53*b* of the traveling pump 53R. The fifth traveling fluid line 45*e* is a fluid line connecting the operation valve 55, the first traveling fluid line 45*a*, the second traveling fluid line 45*b*, the third traveling fluid line 45*c*, and the fourth traveling fluid line 45*d*.

When the traveling operation member 51 is pivoted forward, the operation valve 55A is operated and a pilot pressure is output from the operation valve 55A. This pilot pressure acts on the pressure receiver portion 53*a* of the left traveling pump 53L via the first traveling fluid line 45*a* and on the pressure receiver portion 53*a* of the right traveling pump 53R via the third traveling fluid line 45*c*.

This changes the swash plate angle of the left traveling pump 53L and the right traveling pump 53R, causing the left traveling motor 36L and the right traveling motor 36R to rotate forward (forward rotation) and the working machine 1 to move straight ahead.

When the traveling operation member 51 is pivoted rearward, the operation valve 55B is operated and pilot pressure is output from the operation valve 55B. This pilot pressure acts on the pressure receiver portion 53*b* of the left traveling pump 53L via the second traveling fluid line 45B and on the pressure receiver portion 53*b* of the right traveling pump 53R via the fourth traveling fluid line 45D.

This changes the swash plate angle of the left traveling pump 53L and the right traveling pump 53R, causing the left traveling motor 36L and the right traveling motor 36R to reverse (backward rotation) and the working machine 1 to move straight backward.

When the traveling operation member 51 is pivoted to the right, the operation valve 55C is operated and pilot pressure is output from the operation valve 55C. This pilot pressure acts on the pressure receiver portion 53*a* of the left traveling pump 53L via the first traveling fluid line 45*a* and on the pressure receiver portion 53*b* of the right traveling pump 53R via the fourth traveling fluid line 45*d*.

This changes the swash plate angles of the left traveling pump 53L and the right traveling pump 53R, causing the left traveling motor 36L to rotate forward and the right traveling motor 36R to reverse, causing the working machine 1 to spin turn to the right (super pivot turn).

When the traveling operation member 51 is pivoted to the left, the operation valve 55D is operated and pilot pressure is output from the operation valve 55D. This pilot pressure acts on the pressure receiver portion 53*a* of the right traveling pump 53R via the third traveling fluid line 45*c* and on the pressure receiver portion 53*b* of the left traveling pump 53L via the second traveling fluid line 45*b*.

This changes the swash plate angles of the left traveling pump 53L and the right traveling pump 53R, causing the left traveling motor 36L to reverse and the right traveling motor 36R to rotate forward, causing the working machine 1 to spin turn to the left (super pivot turn).

When the travel operation member 51 is pivoted in an oblique direction, the direction and speed of rotation of the left traveling motor 36L and the right traveling motor 36R are determined by the differential pressure of the pilot pressure acting on the pressure receiver portion 53*a* and 53*b*, and the working machine 1 makes a super pivot turn to the right or a super pivot turn to the left as it moves forward or backward.

According to the working machine 1 in the first embodiment described above, the working machine 1 includes, as a hydraulic device of the traveling system, a traveling pump (left traveling pump 53L, right traveling pump 53R) which can change the flow rate of the hydraulic fluid output according to the pressure of the hydraulic fluid set by a plurality of operation valves 55, and a traveling motor (left traveling motor 36L, right traveling motor 36R) which operates according to the flow rate of the hydraulic fluid output by the traveling pump (left traveling pump 53L, right traveling pump 53R).

The working machine 1 is also provided with a plurality of operation valves 55 (operation valves 55A, 55B, 55C, and 55D) that are capable of outputting hydraulic fluid to operate the hydraulic device of the traveling system and changing the hydraulic fluid supplied to the hydraulic device of the traveling system with a control signal.

The working machine 1 has a pivotally supported traveling operation member 51 and is provided with an operation device 54 capable of outputting an operation signal in accordance with the amount of operation of the traveling operation member 51.

Thus, by operating the traveling operation member 51, the hydraulic device of the traveling system can be operated by a plurality of electrically operated operation valves 55 (operation valves 55A, 55B, 55C, and 55D).

Now, in the above-mentioned embodiment, in addition to the configuration that allows the hydraulic device of the traveling system to be operated by the traveling operation member 51, the control of the controller device 88 allows the working machine 1 to be stable even when the working machine 1 shakes when traveling, and to travel while operating the traveling operation member 51.

The controller device 88 will be described in detail below.

The controller device 88 has a swing calculator portion 88B and a control signal generator portion 188D. The swing calculator portion 88B and the control signal generator portion 188D comprise electrical and electronic circuits provided in the controller device 88 and a program stored in the controller device 88.

The swing calculator portion 88B calculates an evaluation value indicating the degree of rocking of the traveling operation member 51 based on the operation signal. The swing calculator portion 88B increases the evaluation value when the operation signal passes through a neutral signal value corresponding to the neutral position and the operation signal is inflected. The swing calculator portion 88B does not increase the evaluation value if the operation signal passes through the neutral signal value and the operation signal is not inflected.

The swing calculator portion 88B calculates the swinging of the traveling operation member 51 due to vibration of the working machine 1 during traveling and work, and the vibration threshold is a value determined by various tests and experiments.

Figure 3A:
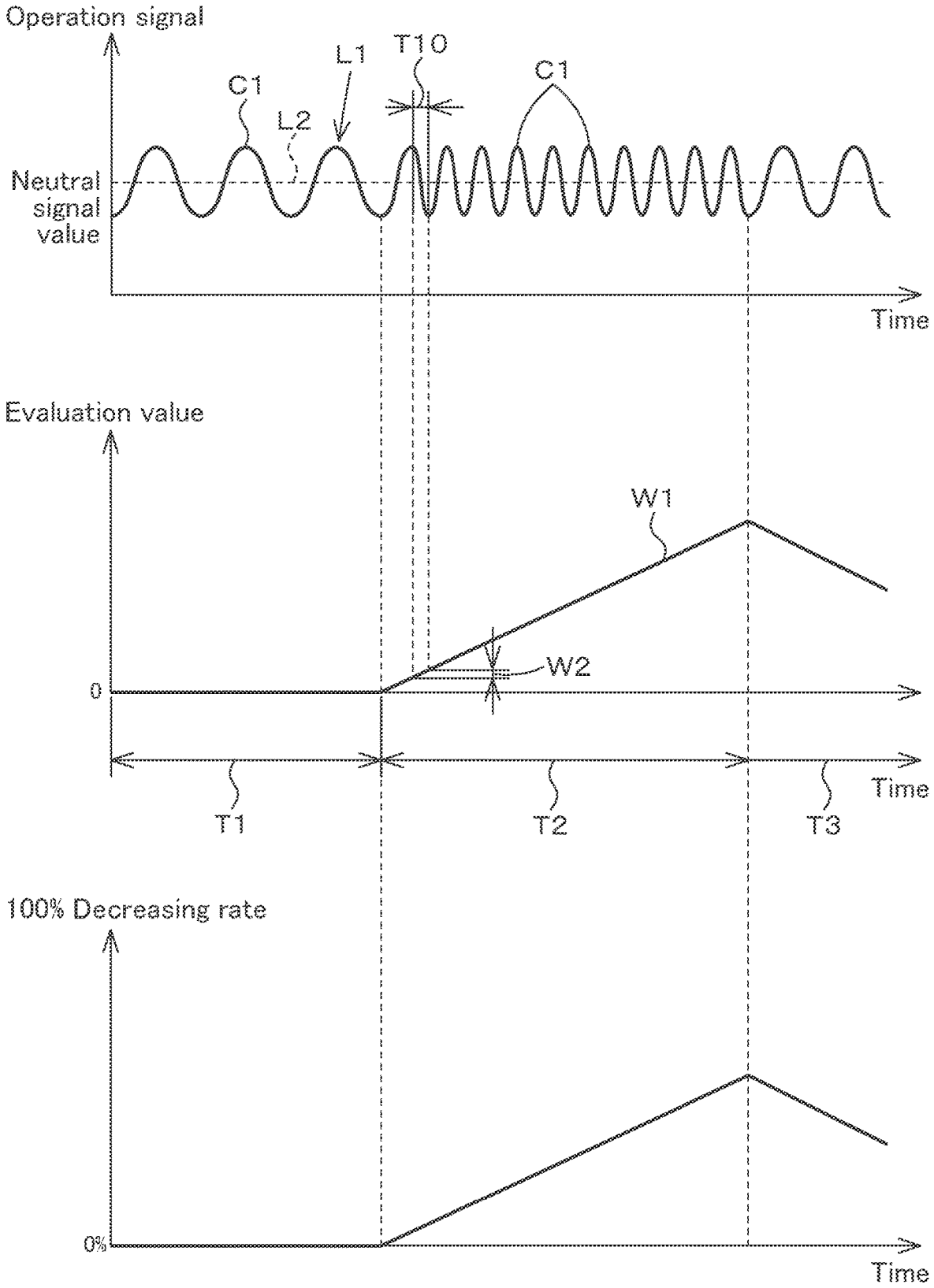
FIG. 3A is a view showing a relation between an operation signal and an evaluation value.

As shown in FIG. 3A, when the operation signal is set to "L1", the inflection point of the operation signal is set to "C1", the evaluation value is set to "W1", and the neutral signal value corresponding to the neutral position is set to "L2", the swing calculator portion 88B monitors whether the operation signal L1 is inflected across the neutral signal value L2 (that is, whether the operation signal L1 is swaying).

The swing calculator portion 88B does not increase the evaluation value W1, as shown in the period T1, when the inflection point C1 does not occur within the predetermined time period T10, even when the operation signal L1 is continuously inflected.

On the other hand, when the operation signal L1 continuously shifts gears and the inflection point C1 occurs within the predetermined time T10, the swing calculator portion 88B gradually increases the evaluation value W1, as shown in period T2.

For example, as shown in period T2 of FIG. 3A, when the operation signal L1 is continuously inflected within the predetermined time T10, the evaluation value W1 is increased by a predetermined constant W2 and the evaluation value W1 is accumulated.

After increasing the evaluation value W1, the swing calculator portion 88B decreases the evaluation value W1 when the inflection point C1 does not occur within the predetermined time T10 under conditions where the operation signal L1 is continuously inflected.

For example, as shown in period T3 of FIG. 3A, when the inflection point C1 does not occur in the operation signal L1 continuously every predetermined time T10, the constant W2 is decreased from the accumulated evaluation value W1 by a constant W2 every time the predetermined time T10 passes.

Figure 3B:
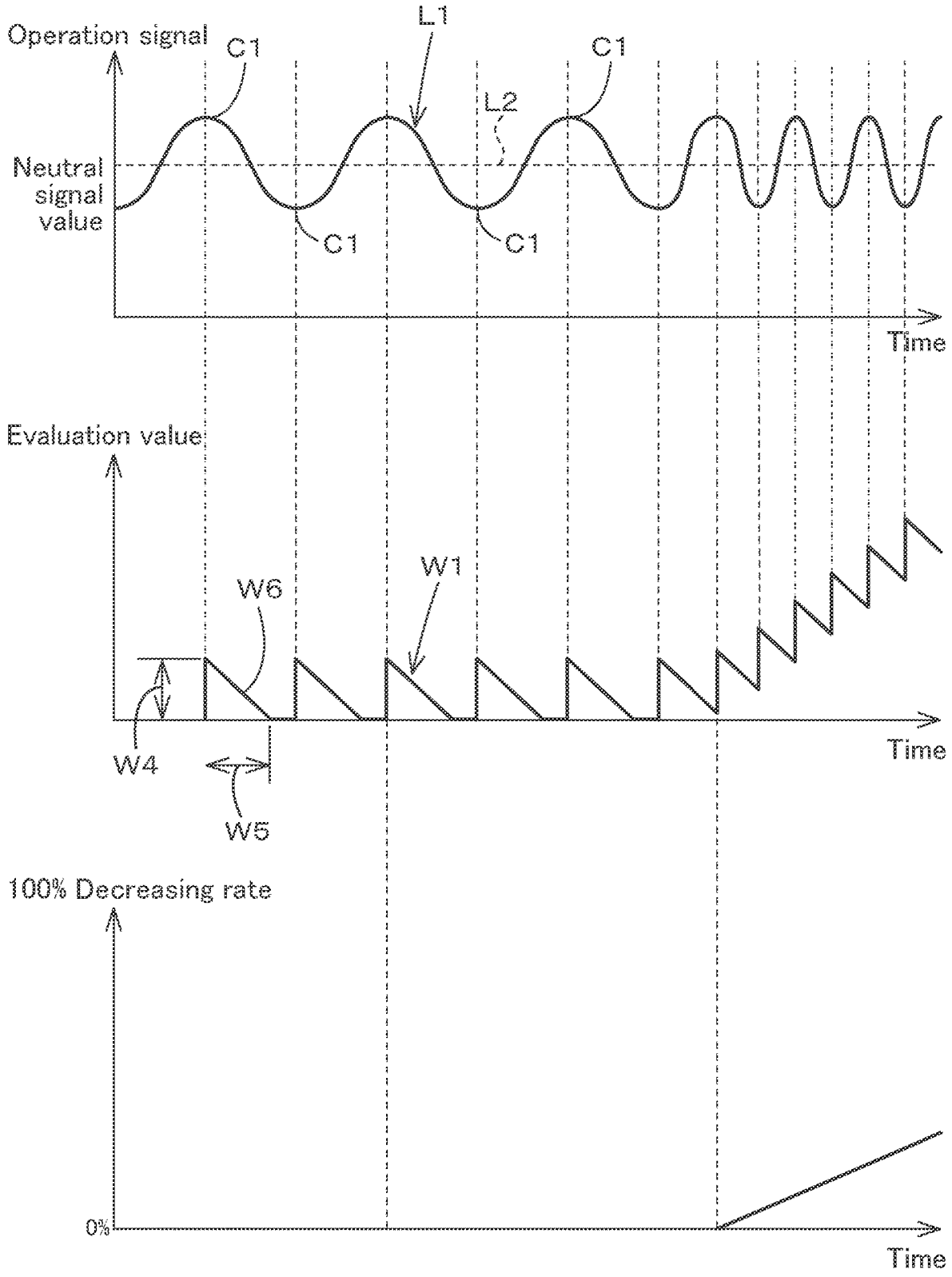
FIG. 3B is a view showing a relation between an operation signal and an evaluation value different from FIG. 3A.

As shown in FIG. 3B, as shown in FIG. 3B, the swing calculator portion 88B may obtain the evaluation value W1 with the operation signal L1 starting at the inflection point C1.

For example, every time the operation signal L1 inflects, the swing calculator portion 88B increases the evaluation value W1 by a constant W4 and then gradually decreases it by a predetermined slope W6 from time C1 (W6=W4/W5). On the other hand, when there is an inflection point C1 within time W5, the evaluation value W1 is accumulated, that is, counted up, by repeating the addition of the constant W4 to the previous evaluation value W1.

Figure 3C:
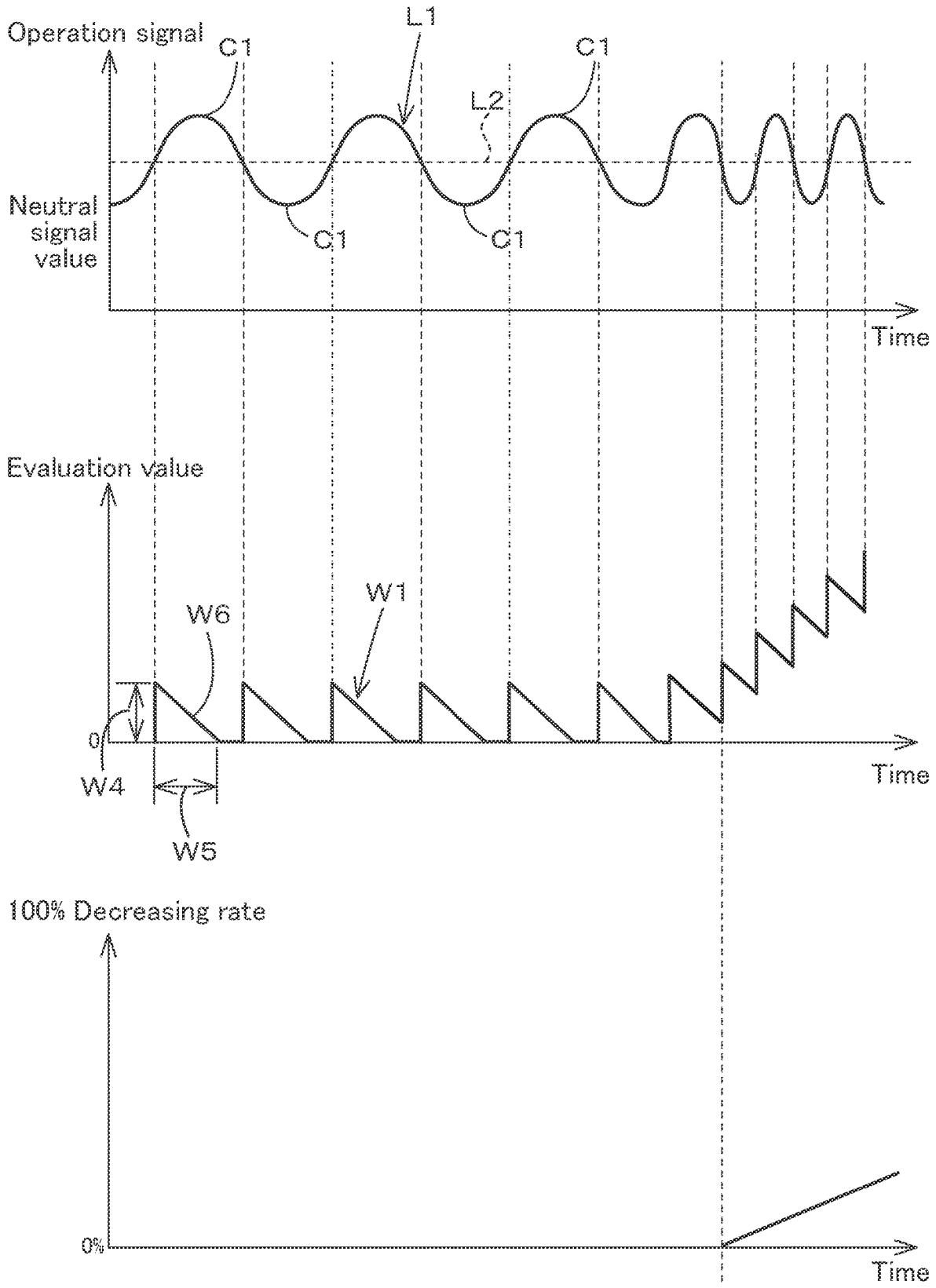
FIG. 3C is a view showing a relation between an operation signal and an evaluation value different from FIG. 3A and FIG. 3B.

As shown in FIG. 3C, the swing calculator portion 88B may obtain an evaluation value W1 for each time the operation signal L1 passes the neutral signal value L2.

For example, the swing calculator portion 88B increases the evaluation value W1 by a constant W4 each time the operation signal L1 passes the neutral signal value L2, and then gradually decreases it at a predetermined slope W6 from time C1 (W6=W4/W5). On the other hand, when the operation signal L1 passes through the neutral signal value L2 within time W5, the evaluation value W1 is accumulated, that is, counted up, by repeating the addition of the constant W4 to the previous evaluation value W1.

In other words, the swing calculator portion 88B increases the evaluation value W1 when the operation signal L1 passes the neutral signal value L2 within the predetermined time, and decreases the evaluation value W1 when it does not pass within the predetermined time.

The control signal generator portion 188D generates a control signal based on the evaluation value W1 and the operation signal L1.

As shown in FIG. 3A, during the period T1 when the evaluation value W1 is zero, the control signal is generated according to the operation signal L1 without decreasing the control signal with respect to the operation signal.

For example, when the control signal generator portion 188D assumes that control signal=operation signal L1×constant×(100%−decrease rate %), in a period T1 where the evaluation value W1 is zero, the decrease rate is zero and the control signal corresponding to that value of the input operation signal L1 is generated.

On the other hand, the control signal generator portion 188D gradually increases the rate of decrease by the evaluation value W1 and decreases the control signal corresponding to the operation signal L1 in the period T2 in which the evaluation value W1 gradually increases.

In the period T3 in which the evaluation value W1 shifts to a decrease, the control signal generator portion 188D gradually decreases the rate of decrease by the evaluation value W1 and increases the control signal corresponding to the operation signal L1.

Figure 4:
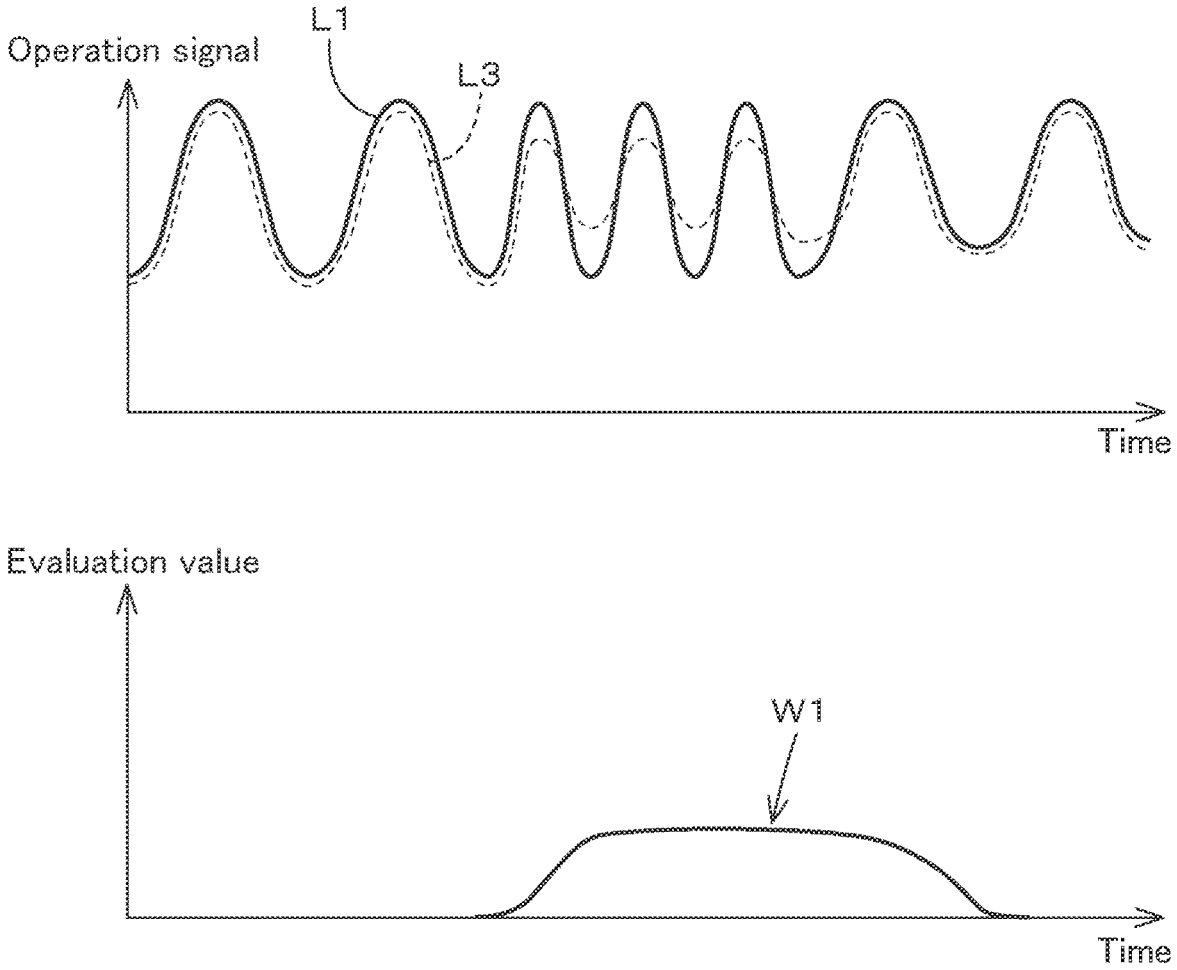
FIG. 4 is a view showing a relation between an evaluation value W1, an operation signal L1, and a control signal L3.

In other words, as shown in FIG. 4, when the evaluation value W1 increases, the control signal L3 corresponding to the operation signal L1 decreases, and when the evaluation value W1 decreases, the control signal L3 corresponding to the operation signal L1 increases.

Figure 5:
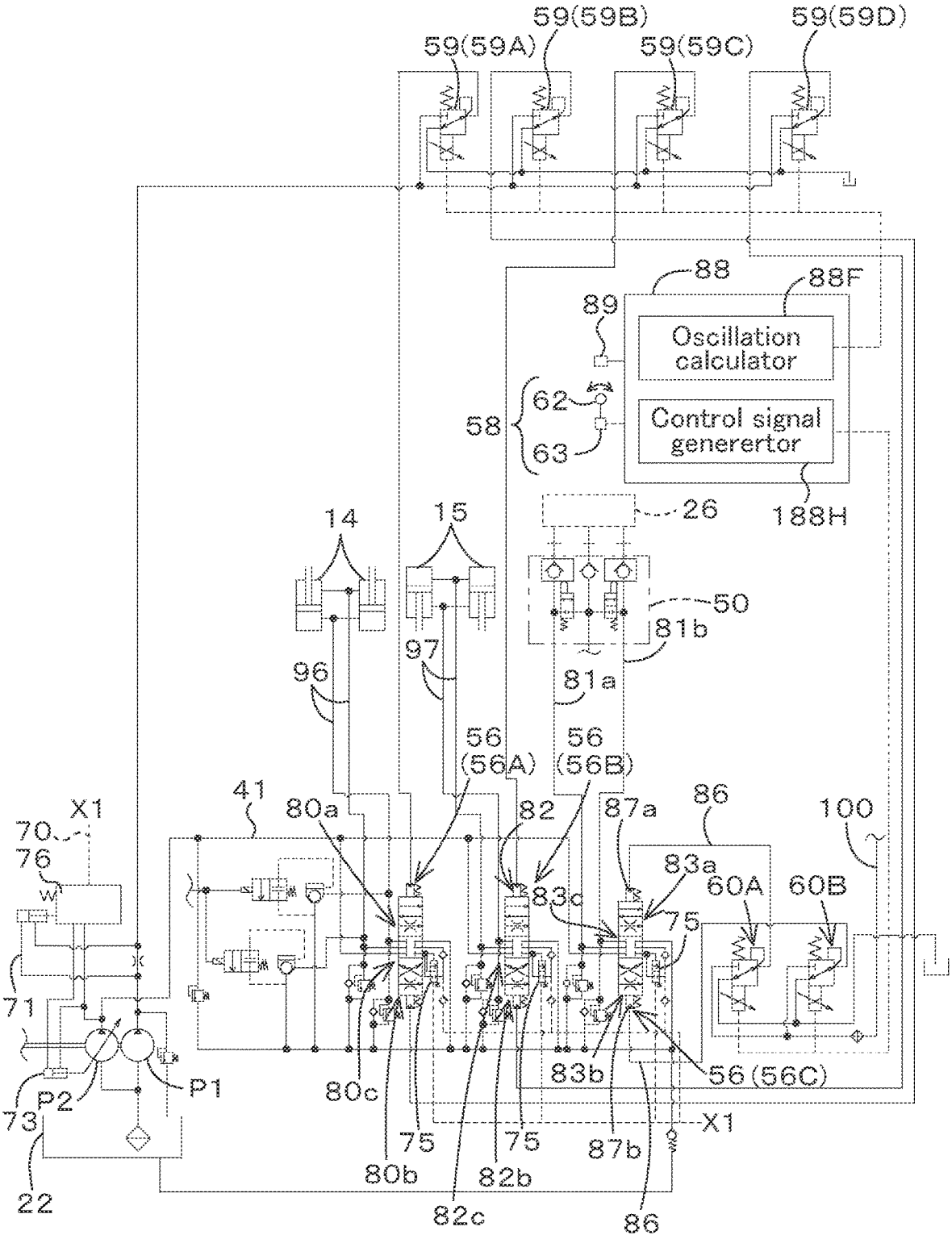
FIG. 5 is a schematic view showing a working hydraulic system for a working machine.

Now, in the above-described embodiment, the hydraulic system of the traveling system was described, but the system can be applied to the hydraulic system of the working system as well. FIG. 5 shows a hydraulic system of a work system.

As shown in FIG. 5, the hydraulic system of the working system is provided with a second hydraulic pump P2 and a plurality of control valves 56. The second hydraulic pump P2 is a pump driven by the power of the prime mover 32 and is composed of a gear pump of a constant displacement type. The second hydraulic pump P2 is capable of outputting hydraulic fluid stored in the hydraulic fluid tank 22 and supplies hydraulic fluid, for example, to the fluid line of the work system.

For example, the second hydraulic pump P2 supplies hydraulic fluid to the control valve (flow control valve) that controls the boom cylinder 14 that operates the boom 10, the working tool cylinder 15 that operates the bucket, and the auxiliary hydraulic actuator that operates the auxiliary hydraulic actuator.

Each of the plurality of control valves 56 is a control valve that is switchable to a plurality of positions (switchable positions) and controls the hydraulic actuator. Each of the plurality of control valves 56 controls, for example, one of the hydraulic actuators, such as the boom cylinder 14, the working tool cylinder 15, and the spare actuator 26 on the auxiliary attachment.

The plurality of control valves 56 include a boom control valve 56A, a working tool control valve 56B, and an auxiliary control valve 56C. The boom control valve 56A is a valve that controls the boom cylinder 14, and the working tool control valve 56B is a valve that controls the working tool cylinder 15.

The boom control valve 56A and the working tool control valve 56B are direct-acting spool-type three-position switching valves of pilot-type, respectively. The boom control valve 56A can be switched to neutral position 80*c*, first position 80*a*, and second position 80*b*. The working tool control valve 56B can be switched to neutral position 82*c*, first position 82*a*, and second position 82*b* by pilot pressure.

A boom cylinder 14 is connected to the boom control valve 56A via the supply-drain fluid line 96. The working tool control valve 56B is connected to the working tool cylinder 15 via the supply-drain fluid line 97.

The working machine 1 is provided with an operation device (working operation device) 58. The operation device (working operation device) 58 is a device for operating the boom cylinder 14 and the working tool cylinder 15, and is capable of switching the boom control valve 56A and the working tool control valve 56B. The operation device (working operation device) 58 includes a working operation member 62 and a detector sensor 63 capable of detecting an amount of operation of the working operation member 62.

The detector sensor 63 is a sensor for detecting an amount of operation of the working operation member 62 from the neutral position. The detector sensor 63 is capable of detecting an operation amount (forward operation amount) of the working operation member 62 when the working operation member 62 is operated forwardly from the neutral position. The detector sensor 63 is capable of detecting an operation amount (backward operation amount) when the working operation member 62 is operated backwardly from the neutral position. The detector sensor 63 is capable of detecting an operation amount (leftward operation amount) when the working operation member 62 is operated from the neutral position to the left (leftward operation amount). The detector sensor 63 is capable of detecting an operation amount (rightward operation amount) when the working operation member 62 is operated from the neutral position to the right (rightward operation amount).

Similar to the detector sensor 52, the detector sensor 63 outputs an operation signal to the controller device 88 in accordance with the amount of operation of the working operation member 62 (forward operation amount, backward operation amount, leftward operation amount, rightward operation amount). That is, the detector sensor 63 gradually increases the operation signal as the operation amount increases. In other words, the detector sensor 63 outputs an operation signal proportional to the amount of operation.

The working operation member 62 is supported from the neutral position and can be tilted back and forth, left and right, and diagonally. By tilting the working operation member 62, each operation valve provided at the bottom of the working operation member 62 can be operated by tilting the working operation member 62. The working machine 1 is provided with a plurality of operation valves 59, and the plurality of operation valves 59 include operation valves 59A, 59B, 59C and 59D.

When the work operation member 62 is tilted forward, the control valve 59A is operated and a pilot pressure is output from the control valve 59A. This pilot pressure acts on the pressure receiver portion of the boom control valve 56A, causing the boom control valve 56A to switch to the first position 80*a* and the boom 10 to descend.

When the work operation member 62 is tilted backward, the control valve 59B is operated and a pilot pressure is output from the control valve 59B. This pilot pressure acts on the pressure receiver portion of the boom control valve 56A, causing the boom control valve 56A to switch to the second position 80B and the boom 10 to rise.

When the working operation member 62 is tilted to the right, the operation valve 59C for bucket dumping is operated and pilot pressure is output from the operation valve 59C for bucket dumping. This pilot pressure acts on the pressure receiver portion of the working tool control valve 56B, and the working tool control valve 56B is switched to the first position 82*a*, and the bucket 11 performs the dumping operation.

When the working operation member 62 is tilted to the left, the operation valve 59D for the bucket squeezing is operated, and pilot pressure is output from the operation valve 59D for the bucket squeezing. This pilot pressure acts on the pressure receiver portion of the working tool control valve 56B, and the working tool control valve 56B is switched to the second position 82B, and the bucket 11 performs the scooping operation.

The auxiliary control valve 56C is a valve that controls the auxiliary actuator 26 and is a direct-acting spool-type four-position switching valve of pilot-type. The auxiliary control valve 56C is switched to neutral position 83C, first position 83A, second position 83B, and third position 83D with pilot pressure.

That is, the auxiliary control valve 56C controls the direction, flow rate and pressure of the hydraulic fluid going to the auxiliary hydraulic actuator by switching to the first position 83*a*, the second position 83*b* and the third position 83*d*.

As shown in FIG. 5, a first supply-drain fluid line 81*a* and a second supply-drain fluid line 81*b* are connected to the auxiliary control valve 56C. One end of the first supply-drain fluid line 81*a* is connected to the first feed and drain port 84 of the auxiliary control valve 56C. A midway of the first supply-drain fluid line 81*a* is connected to a connecting member 50.

The other end of the first supply-drain fluid line 81*a* is connected to the auxiliary actuator 26. One end of the second supply-drain fluid line 81*b* is connected to the second feed and drain port 85 of the auxiliary control valve 56C. A midway of the second fluid supply and drain line 81*b* is connected to a connecting member 50. The other end of the second supply/drain fluid line 81*b* is connected to the auxiliary actuator 26.

The auxiliary control valve 56C is operated by a plurality of proportional valves 60. The proportional valve 60 is a solenoid valve whose opening can be changed by magnetization. The plurality of proportional valves 60 are a first proportional valve 60A and a second proportional valve 60B. The first proportional valve 60A and the second proportional valve 60B are connected to the first hydraulic pump P1 via the fluid line 100.

The proportional valve 60 (first proportional valve 60A and second proportional valve 60B) and the auxiliary control valve 56C are connected by a pilot fluid line 86. The pilot fluid route 86 is a fluid line that allows pilot fluid to flow through the proportional valve 60 (first proportional valve 60A and second proportional valve 60B) to the auxiliary control valve 56C.

Thus, when the first proportional valve 60A is opened, the pilot fluid acts on the pressure receiver portion 87*a* of the auxiliary control valve 56C via the pilot fluid line 86, and the opening of the first proportional valve 60A determines the pilot pressure to be applied to (acted on) the pressure receiver portion 87*a*.

When the second proportional valve 60B is opened, the pilot fluid acts on the pressure receiver portion 87B of the auxiliary control valve 56C via the pilot fluid line 86, and the pilot pressure applied to (acting on) the pressure receiver portion 87B is determined by the degree of opening of the second proportional valve 60B.

Excitation and the like of the proportional valves 60 (first proportional valve 60A and second proportional valve 60B) are performed by the controller device (first controller device) 88. The controller device 88 comprises a CPU and the like. An operating member 89 such as a switch or the like is connected to the controller device 88. The openings of the first proportional valve 60A and the second proportional valve 60B are set based on the amount of operation of the operative member 89.

As a result, the pilot pressure of either the first proportional valve 60A or the second proportional valve 60B acts on the pressure receiver portions 87*a* and 87*b* of the auxiliary control valve 56C, allowing the auxiliary actuator 26 to be operated.

The hydraulic system for the working machine is provided with a load sensing system. The load sensing system is a system for controlling the second hydraulic pump P2 so that the differential pressure between the maximum load pressure and the discharge pressure of the second hydraulic pump P2 at the time of operation of the hydraulic actuator is constant (controlling the discharge volume of the second hydraulic pump P2).

The load sensing system has a PLS fluid line 70 with a pressure compensation valve 75 connected to a plurality of control valves 56, a PPS fluid line 71, a regulator 76, and a tilting piston 73.

Of the plurality of control valves 56, the pressure with the highest load pressure (PLS signal pressure) acts on the PLS fluid line 70, while the PPS fluid line 71 is transmitted to the regulator 76. The regulator 76 actuates the tilting piston 73 so that the differential pressure (PPS signal pressure−PLS signal pressure) between the PPS signal pressure and the PLS signal pressure, which is the discharge pressure of the hydraulic fluid of the second hydraulic pump P2, is constant.

The controller device 88 has a swing calculator portion 88F and a control signal generator portion 188H. The swing calculator portion 88F and the control signal generator portion 188H comprise electrical and electronic circuits provided in the controller device 88 and a program stored in the controller device 88.

The only difference between the configurations of the swing calculator portion 88F and the control signal generator portion 188H is in that the operation signal is a signal output from the detector sensor 63 and in that the control signal is a signal output to each of the multiple operation valves 59. For the other configurations, the swing calculator portion 88B and the control signal generator portion 188D have the same configuration.

That is, in the description of the swing calculator portion 88B and the control signal generator portion 188D described above, each of the traveling operation member 51 and the plurality of operation valves 55 (operation valves 55A, 55B, 55C, and 55D) is read as the working operation member 62 and the plurality of operation valves 59 (operation valves 59A, 59B, 59C, and 59D), which becomes the description of the swing calculator portion 88F and the control signal generator portion 188H.

The control signal generator portion 188D may switch to a mode in which the relation between the operation signal (working operation signal) and the amount of movement of the spool at the control valve 56, for example, the working tool control valve 56B, is a second map different from the predetermined first map when the evaluation value W1 is greater than or equal to a threshold value.

That is, the control signal generator portion 188D may switch to a mode in which the relation between the operation signal (working operation signal) and the control signal to be output to the working tool control valve 56B (a map showing the relation between the operation signal and the control signal) is a second map that is different from the predetermined first map when the evaluation value W1 is greater than or equal to a threshold value.

The hydraulic system for the working machine includes the hydraulic device, the operation valves 55 and 59 to supply operation fluid to operate the hydraulic device and to vary the operation fluid to be supplied to the hydraulic device, the operation devices 54 and 58 having the operation member (traveling operation member 51, working operation member 62) supported swingably, the operation device being configured to output an operation signal in accordance with an operation amount of the operation member (traveling operation member 51, working operation member 62), and the controller 88 including the swing calculators 88B and 88F to calculate an evaluation value representing a degree of swinging of the operation member (traveling operation member 51, working operation member 62), and the control signal generators 188H and 188D to generate a control signal based on the evaluation value W1 and the operation signal.

According to this configuration, based on the evaluation value W1, which is the degree of swaying of the travel operation member 51 and the working operation member 62, a control signal corresponding to the operation signal can be output or the control signal can be reduced compared to the operation signal. This allows the hydraulic device to be easily operated as intended by the operator.

For example, when the operator momentarily operates each of the traveling operation member 51 and the working operation member 62, the hydraulic device is activated by outputting a control signal corresponding to the amount of operation (operation signal) to the operation valves 55 and 59. When the traveling operation member 51 and the working operation member 62 are swayed by the traveling or work of the working machine 1 (various work itself, such as ground conditions, characteristics of the working machine, and the like) regardless of the intention of the operator, the operation signal is lowered in response to the amount of operation (operation signal). This prevents hunting and jerking in response to swaying due to traveling and work.

In other words, the control signal can be changed according to the case where the operator grasps the operation member (traveling operation member 51 and work operation member 62) and the operation member is shaken by the traveling or traveling of the working machine 1, or where the operator intentionally operates the operation member.

The swing calculator portions 88B and 88F increase the evaluation value W1 when the operation signal passes the neutral signal value corresponding to the neutral position within a predetermined time. When the operation signal does not pass through the neutral signal value within the predetermined time, the evaluation value W1 is not increased.

According to this configuration, the evaluation value W1 can be obtained when the traveling operation member 51 and the working operation member 62 are swaying across the neutral position due to the vibration of the working machine 1, for example.

The swing calculator portions 88B and 88F increase the evaluation value W1 when the operation signal is inflected within the predetermined time T10. The rocking operation devices 88B and 88F decrease the evaluation value W1 when the operation signal is not inflected within the predetermined time T10.

According to this configuration, it is possible to obtain the evaluation value W1 when the traveling operation member 51 and the working operation member 62 are swinging due to the vibration of the working machine 1, and the like.

The swing calculator portions 88B and 88F decrease the value of the control signal with respect to the operation signal as the evaluation value W1 increases. According to this configuration, the control signal can be suppressed in response to the swaying of the working machine 1.

The swing calculator portions 88B and 88F increase the value of the control signal with respect to the operation signal as the evaluation value W1 decreases. According to this configuration, when the swaying of the working machine 1 has been stopped, the control signal can be returned to the original state and the state of not swaying.

The hydraulic device includes a traveling pump (left traveling pump 53L, right traveling pump 53R) that can change the flow rate of the hydraulic fluid output according to the pressure of the hydraulic fluid set by the operation valves 55 and 59, and a traveling motor (left traveling motor 36L, right traveling motor 36R) that operates according to the flow rate of the hydraulic fluid output by the traveling pump (left traveling pump 53L, right traveling pump 53R).

According to this configuration, the operator's intended operation can be carried out when the driving operation member 51 is operated by the driving system (traveling pump and traveling motor).

The hydraulic device includes a boom cylinder 14 to actuate the boom 10, the working tool cylinder 15 to actuate the working tool mounted on the end of the boom 10, the boom control valve 56A to control the hydraulic fluid supplied to the boom cylinder 14 according to the pressure of the hydraulic fluid set by the operation valves 55 and 59, and the working tool control valve 56B to control the hydraulic fluid supplied to the working tool cylinder 15 according to the pressure of the hydraulic fluid set by the operation valves 55 and 59.

This allows the operator to operate the working operation device 62 to raise and lower the boom 10 or operate the working machine as intended by the operator.

In the above-mentioned embodiment, the output of the control signal was changed according to the evaluation value W1. However, when the operation signal is a signal of the traveling system, that is, the operation signal when the traveling operation member 51 is operated (the traveling operation signal), the control signal generator portions 188D and 188H may decrease the control signal in accordance with the evaluation value W1.

When the operation signal is a work system signal, for example, when the operation signal is an operation signal for operating the working operation member 62 (working operation signal) and the working operation signal is a working operation signal for operating the bucket 11, the control signal generator portions 188D and 188H may not make the control signal according to the evaluation value W1.

According to this configuration, when turning the working machine 1, the operation can be performed in response to the vibration of the working machine 1, and when operating the bucket 11, the bucket 11 can be finely operated in response to the operator's operation.

The control signal generator portion 188H may decrease the control signal according to the evaluation value W1 when the working operation signal is a working operation signal to operate the boom 10.

In this manner, when the working tool 11 is raised or lowered (when the boom 10 is raised or lowered), the operation can be performed in response to the vibration of the working machine 1.

In other words, the control signal generator portions 188D and 188H may decrease (lower) the control signal according to the evaluation value W1 when the operation signal is a predetermined operation signal (a signal to be removed). The control signal generator portions 188D and 188H may not decrease (lower) the control signal when the operation signal is not a signal to be removed.

According to this configuration, depending on the type of work, the operation can be performed in response to the vibration of the working machine 1, and the operation can also be performed in response to the operation of the operator.

Second Embodiment

A second embodiment of the present invention is described. When the configuration described in the first embodiment is used in the description of the second embodiment, the same reference code as the reference code in the first embodiment is used with the configuration.

The working machine according to the second embodiment, in addition to being configured to operate the hydraulic device of the traveling system by the traveling operation member 51, can, by control of the controller device 88, be stable even when the working machine 1 shakes while traveling, and can travel while operating the traveling operation member 51.

The controller device 88 according to the second embodiment will be described in detail.

The controller device 88 has a filter portion 88A, a swing calculator portion 88B, a signal judgment portion 88C, and a control signal generator portion 88D. The filter portion 88A, the swing calculator portion 88B, the signal judgment portion 88C, and the control signal generator portion 88D includes electrical and electronic circuits provided in the controller device 88, a program stored in the controller device 88, and the like.

The filter portion 88A removes a predetermined frequency component from the operation signal. The filter portion 88A is, for example, a low-pass filter that removes a predetermined frequency component from the operation signal obtained by the controller device 88 and outputs it to the control signal generator portion 88D. Or, the filter portion 88A is a low-pass filter that removes a predetermined frequency component, for example, to the control signal generated by the control signal generator portion 88D.

The swing calculator portion 88B calculates an evaluation value indicating the degree of swaying of the traveling operation member 51 based on the operation signal. The swing calculator portion 88B increases the evaluation value when the operation signal acquired by the control device 88 is inflected within a predetermined time, and decreases the evaluation value when the operation signal acquired by the control device 88 is not inflected within a predetermined time.

The swing calculator portion 88B calculates the swinging of the traveling operation member 51 due to vibration of the working machine 1 during traveling and work, and the vibration threshold is a value determined by various tests and experiments.

As shown in FIG. 3A, when the operation signal is set to "L1", the inflection point of the operation signal is set to "C1", and the evaluation value is set to "W1", the swing calculator portion 88B monitors whether the operation signal L1 is inflected (that is, whether the operation signal L1 is swinging) per predetermined time T10.

The swing calculator portion 88B does not increase the evaluation value W1, as shown in period T1, when the operation signal L1 is continuously changing gears and the inflection point C1 does not occur within the predetermined time T10. On the other hand, the swing calculator portion 88B gradually increases the evaluation value W1, as shown in period T2, when the operation signal L1 is continuously changing speed and the inflection point C1 occurs within the predetermined time T10.

For example, as shown in period T2 of FIG. 3A, when the operation signal L1 is continuously inflected within the predetermined time T10, the evaluation value W1 is increased by a predetermined constant W2 and the evaluation value W1 is accumulated.

After increasing the evaluation value W1, the swing calculator portion 88B decreases the evaluation value W1 when the inflection point C1 does not occur within the predetermined time T10 under conditions where the operation signal L1 is continuously inflected.

For example, as shown in period T3 of FIG. 3A, when the inflection point C1 does not occur in the operation signal L1 continuously every predetermined time T10, the constant W2 is decreased from the accumulated evaluation value W1 by a constant W2 every time the predetermined time T10 passes.

As shown in FIG. 3B, the swing calculator portion 88B may obtain the evaluation value W1 starting at the inflection point C1, wherein the operation signal L1 is inflected. For example, the swing calculator portion 88B increases the evaluation value W1 by a constant W4 each time the operation signal L1 inflects, and then gradually decreases it by a predetermined slope W6 from the point C1 (W6=W4/W5).

On the other hand, when there is an inflection point C1 within time W5, the swing calculator portion 88B adds a constant W4 to the previous evaluation value W1 and repeats the addition of the constant W4 to the previous evaluation value W1, thereby integrating the evaluation value W1, that is, counting up.

As shown in FIG. 3C, the swing calculator portion 88B may obtain the evaluation value W1 each time the operation signal L1 passes the neutral signal value L2 corresponding to the neutral position of the traveling operation member 51. For example, the swing calculator portion 88B increases the evaluation value W1 by a constant W4 each time the operation signal L1 passes the neutral signal value L2, and then gradually decreases the evaluation value W1 at a predetermined slope W6 from the point C1 (W6=W4/W5).

On the other hand, when the operation signal L1 passes the neutral signal value L2 within the time W5, the swing calculator portion 88B accumulates the evaluation value W1 by repeating the addition of the constant W4 to the one previous evaluation value W1, that is, it counts up. In other words, the swing calculator portion 88B increases the evaluation value W1 when the operation signal L1 passes the neutral signal value L2 corresponding to the neutral position within the predetermined time, and decreases the evaluation value W1 when it does not pass within the predetermined time.

The signal judgment portion 88C determines whether or not to remove the operation signal L1 or any of the control signals based on the evaluation value W1 calculated by the swing calculator portion 88B.

As shown in FIG. 3A and FIG. 3B, the signal judgment portion 88C determines that when the evaluation value W1 reaches or exceeds the threshold value Q1, it determines that removal is performed for either the operation signal L1 or the control signal for which the evaluation value W1 reaches or exceeds the threshold value Q1, and does not determine that removal is performed for the operation signal L1 for which the evaluation value W1 is less than the threshold Q1.

The control signal generator portion 88D generates a control signal based on the operation signal L1. The control signal generator portion 88D generates a control signal for the operation signal L1 (L1*a*) that has been removed at a predetermined frequency by the filter portion 88A when the signal judgment portion 88C determines that the removal is performed.

The control signal generator portion 88D generates a control signal for the operation signal L1 (L1*b*), which was not removed by the filter portion 88A, when the signal judgment portion 88C determines that the removal is not performed.

FIG. 4A and FIG. 4B are diagrams summarizing the processing of the operation and control signals. Based on FIG. 4A and FIG. 4B, the processing will be described in detail.

As shown in FIG. 4A, when the controller device 88 obtains the operation signal L1 from the detector sensor 52 (step S10), the evaluation value W1 is calculated by the swing calculator portion 88B (step S11).

After computing the evaluation value W1, the signal judgment portion 88C determines whether or not to remove the filter by the filter portion 88A for the operation signal L1 based on the evaluation value W1 and the threshold value Q1 (step S12: filter judgment processing).

In the filter determination process at step S12, when the evaluation value W1 is greater than or equal to the threshold value Q1 (step S12, Yes), it is determined that the filter processing is performed on the operation signal L1, and when the evaluation value W1 is less than the threshold value Q1 (step S12, No), it is determined that the filter processing is not performed on the operation signal L1.

When the signal judgment portion 88C determines that filter processing is performed (step S12, Yes), the operation signal L1 is processed by the filter portion 88A to perform the filter processing (step S13).

The control signal generator portion 88D generates a control signal for the filtered operation signal L1*a* when filter processing is performed, and generates a control signal for the unfiltered operation signal (the operation signal obtained by the control device 88) L1*b* when the filter processing is not performed (step S14).

For example, in the case of filter processing, the control signal generator portion 88D sets a current value (target current value) corresponding to the magnitude of the operation signal L1*a*, which has passed through the low-pass filter, and generates a control signal that gives the set current value (target current value).

On the other hand, when no filter processing is performed, the control signal generator portion 88D sets a current value (target current value) in response to the magnitude of the operation signal L1*b* obtained by the controller device 88, and generates a control signal that gives the set current value (target current value).

The controller device 88 then outputs the control signal (the signal corresponding to the target current value) generated by the control signal generator portion 88D to the operation valve 55 (step S15).

As shown in FIG. 4B, when the controller device 88 obtains the operation signal L1 from the detector sensor 52 (step S10), the evaluation value W1 is calculated by the swing calculator portion 88B (step S11).

The control signal generator portion 88D generates a control signal for the operation signal L1*b* obtained by the controller device 88 (step S20).

That is, the control signal generator portion 88D sets a current value (target current value) in response to the magnitude of the operation signal Llb obtained by the controller device 88.

The signal judgment portion 88C determines whether or not the filter removal is performed on the control signal by the filter portion 88A based on the evaluation value W1 and the threshold value Q1 (step S21: Filter judgment processing).

In the filter determination process at step S12, when the evaluation value W1 is greater than or equal to the threshold value Q1 (step S21, Yes), it is determined that filter processing is performed on the control signal, and when the evaluation value W1 is less than the threshold value Q1 (step S21, No), it is determined that no filter processing is performed on the control signal.

When the signal judging section 88C determines that filter processing is to be performed (step S21, Yes), the control signal generated in S20 is processed by the filter portion 88A to perform the filter processing (step S22).

When the controller device 88 performs filter processing on the control signal, the control signal after the filter processing is performed is output to the control valve 55, and when the control signal is not filtered on the control signal, the control signal that was not filtered (the control signal generated in S20) is output to the control valve 55 (step S23).

The swing calculator portion 88B may change the frequency at which the removal is performed by the filter portion 88A. The swing calculator portion 88B decreases the cut-off frequency as the evaluation value W1 increases.

For example, as shown in FIG. 3B, the cutoff frequency is decreased as the evaluation value W1 increases. For example, the swing calculator portion 88B decreases the cutoff frequency as the evaluation value W1 increases.

For example, when the cutoff frequency is 10 Hz when the evaluation value W1 is zero, the swing calculator portion 88B gradually decreases the cutoff frequency from 10 Hz, similarly to the evaluation value W1. The cutoff frequency is an example and is not limited thereto.

The threshold Q1 is stored in the controller device 88, but may be changeable. For example, a screen for setting the threshold Q1 may be displayed on a display device provided on the working machine 1, and the threshold Q1 may be changed on the screen.

Now, in the above-described embodiment, the hydraulic system of the traveling system was described, but the system can be applied to the hydraulic system of the working system as well. FIG. 4 illustrates a hydraulic system of a working system.

The following is a description of the hydraulic system of the working system.

As shown in FIG. 5, the hydraulic system of the working system is provided with the second hydraulic pump P2 and a plurality of the control valves 56. The second hydraulic pump P2 is a pump driven by the power of the prime mover 32 and is composed of a gear pump of a constant displacement type. The second hydraulic pump P2 is capable of outputting hydraulic fluid stored in the hydraulic fluid tank 22 and supplies hydraulic fluid, for example, to the fluid line of the working system.

For example, the second hydraulic pump P2 supplies hydraulic fluid to the control valve (flow control valve) that controls the boom cylinder 14 that operates the boom 10, the working tool cylinder 15 that operates the bucket, and the auxiliary hydraulic actuator that operates the auxiliary hydraulic actuator.

Each of the plurality of control valves 56 is a control valve that is switchable to a plurality of positions (switchable positions) and controls the hydraulic actuator. Each of the plurality of control valves 56 controls, for example, one of the hydraulic actuators, such as the boom cylinder 14, the working tool cylinder 15, and the spare actuator 26 on the auxiliary attachment.

The plurality of control valves 56 include a boom control valve 56A, a working tool control valve 56B, and an auxiliary control valve 56C. The boom control valve 56A is a valve that controls the boom cylinder 14. The working tool control valve 56B is a valve that controls the working tool cylinder 15.

The boom control valve 56A and the working tool control valve 56B are direct-acting spool-type three-position switching valves of pilot-type, respectively. The boom control valve 56A can be switched to neutral position 80C, first position 80A, and second position 80B.

The working tool control valve 56B is switched to neutral position 82C, first position 82A and second position 82B by pilot pressure. The boom control valve 56A is connected to the boom cylinder 14 via the supply-drain fluid line 96, and the working tool control valve 56B is connected to the working tool cylinder 15 via the supply-drain fluid line 97.

The working machine 1 is provided with an operation device (working operation device) 58. The operation device (working operation device) 58 is a device for operating the boom cylinder 14 and the working tool cylinder 15, and is capable of switching the boom control valve 56A and the working tool control valve 56B.

The operation device (working operation device) 58 includes a working operation member 62 and a detector sensor 63 capable of detecting the amount of operation of the working operation member 62.

The detector sensor 63 is a sensor for detecting an amount of operation of the working operation member 62 from the neutral position. The detector sensor 63 is capable of detecting an operation amount (forward operation amount) of the working operation member 62 when the working operation member 62 is operated forwardly from the neutral position. The detector sensor 63 is capable of detecting an operation amount (backward operation amount) when the working operation member 62 is operated backwardly from the neutral position. The detector sensor 63 is capable of detecting an operation amount (leftward operation amount) when the working operation member 62 is operated from the neutral position to the left (leftward operation amount). The detector sensor 63 is capable of detecting an operation amount (rightward operation amount) when the working operation member 62 is operated from the neutral position to the right.

Similar to the detector sensor 52, the detector sensor 63 outputs an operation signal to the controller device 88 in accordance with the amount of operation of the working operation member 62 (forward operation amount, backward operation amount, leftward operation amount, rightward operation amount). That is, the detector sensor 63 gradually increases the operation signal as the operation amount increases. In other words, the detector sensor 63 outputs an operation signal proportional to the amount of operation.

The working operation member 62 is supported from the neutral position and can be tilted back and forth, left and right, and diagonally. By tilting the working operation member 62, each operation valve provided at the bottom of the working operation member 62 can be operated by tilting the working operation member 62. The working machine 1 is provided with a plurality of operation valves 59, and the plurality of operation valves 59 include operation valves 59A, 59B, 59C and 59D.

When the work operation member 62 is tilted forward, the control valve 59A is operated and a pilot pressure is output from the control valve 59A. This pilot pressure acts on the pressure receiver portion of the boom control valve 56A, causing the boom control valve 56A to switch to the first position 80*a* and the boom 10 to descend.

When the work operation member 62 is tilted backward, the control valve 59B is operated and a pilot pressure is output from the control valve 59B. This pilot pressure acts on the pressure receiver portion of the boom control valve 56A, causing the boom control valve 56A to switch to the second position 80B and the boom 10 to rise.

When the working operation member 62 is tilted to the right, the operation valve 59C for bucket dumping is operated and pilot pressure is output from the operation valve 59C for bucket dumping. This pilot pressure acts on the pressure receiver portion of the working tool control valve 56B, and the working tool control valve 56B is switched to the first position 82*a*, and the bucket 11 is dumped operation.

When the working operation member 62 is tilted to the left, the operation valve 59D for the bucket squeezing is operated, and pilot pressure is output from the operation valve 59D for the bucket scooping. This pilot pressure acts on the pressure receiver portion of the working tool control valve 56B, and the working tool control valve 56B is switched to the second position 82B, and the bucket 11 performs the scooping operation.

The auxiliary control valve 56C is a valve that controls the auxiliary actuator 26 and is a direct-acting spool-type four-position switching valve pilot-type. The auxiliary control valve 56C is switched to neutral position 83C, first position 83A, second position 83B, and third position 83D by pilot pressure.

That is, the auxiliary control valve 56C controls the direction, flow rate and pressure of the hydraulic fluid going to the auxiliary hydraulic actuator by switching to the first position 83*a*, the second position 83*b* and the third position 83*d*.

A first supply-drain fluid line 81*a* and a second supply-drain fluid line 81*b* are connected to the auxiliary control valve 56C. One end of the first fluid supply and drain line 81*a* is connected to the first feed and drain port of the auxiliary control valve 56C. A midway of the first fluid supply and drainage route 81*a* is connected to a connecting member 50. The other end of the first supply-drain fluid line 81*a* is connected to the auxiliary actuator 26.

One end of the second supply-drain fluid line 81*b* is connected to the second feed and drain port of the auxiliary control valve 56C. A midway portion of the second fluid supply and drain line 81*b* is connected to a connecting member 50. The other end of the second supply-drain fluid line 81*b* is connected to the auxiliary actuator 26.

The auxiliary control valve 56C is operated by a plurality of proportional valves 60. The proportional valve 60 is a solenoid valve whose opening can be changed by magnetization. The plurality of proportional valves 60 are a first proportional valve 60A and a second proportional valve 60B. The first proportional valve 60A and the second proportional valve 60B are connected to the first hydraulic pump P1 via the fluid line 100.

The proportional valve 60 (first proportional valve 60A and second proportional valve 60B) and the auxiliary control valve 56C are connected by a pilot fluid line 86. The pilot fluid route 86 is a fluid line that allows pilot fluid to flow through the proportional valve 60 (first proportional valve 60A and second proportional valve 60B) to the auxiliary control valve 56C.

Thus, when the first proportional valve 60A is opened, the pilot fluid acts on the pressure receiver portion 87*a* of the auxiliary control valve 56C via the pilot fluid line 86, and the opening of the first proportional valve 60A determines the pilot pressure to be applied (acted on) to the pressure receiver portion 87*a*.

When the second proportional valve 60B is opened, the pilot fluid acts on the pressure receiver portion 87B of the auxiliary control valve 56C via the pilot fluid line 86, and the pilot pressure applied to (acting on) the pressure receiver portion 87B is determined by the degree of opening of the second proportional valve 60B.

Magnetization and the like of the proportional valves 60 (the first proportional valve 60A and the second proportional valve 60B) is performed by the controller device 88. An operating member 89, such as a switch, is connected to the controller device 88. The degree of opening of the first and second proportional valves 60A and 60B is set based on the amount of operation of the operative member 89. As a result, the pilot pressure of either the first proportional valve 60A or the second proportional valve 60B acts on the pressure receiver portions 87*a* and 87*b* of the auxiliary control valve 56C, allowing the auxiliary actuator 26 to be operated.

The hydraulic system of the working machine is provided with a load sensing system. The load sensing system is a system for controlling the second hydraulic pump P2 so that the differential pressure between the maximum load pressure and the output pressure of the second hydraulic pump P2 at the time of operation of the hydraulic actuator is constant (controlling the discharge volume of the second hydraulic pump P2).

The load sensing system has a PLS fluid line 70 with a pressure compensation valve 75 connected to a plurality of control valves 56, a PPS fluid line 71, a regulator 76, and a tilting piston 73.

Of the plurality of control valves 56, the pressure with the highest load pressure (PLS signal pressure) acts on the PLS fluid line 70, while the PPS fluid line 71 is transmitted to the regulator 76. The regulator 76 actuates the tilting piston 73 so that the differential pressure (PPS signal pressure−PLS signal pressure) between the PPS signal pressure and the PLS signal pressure, which is the discharge pressure of the hydraulic fluid of the second hydraulic pump P2, is constant.

The controller device 88 has a filter portion 88E, a swing calculator portion 88F, a signal judgment portion 88G, and a control signal generator portion 88H. Each of the filter portion 88E, the swing calculator portion 88F, the signal judgment portion 88G, and the control signal generator portion 88H includes electrical and electronic circuits provided in the controller device 88, a program stored in the controller device 88, and the like.

The filter portion 88E, the swing calculator portion 88F, the signal judgment portion 88G and the control signal generator portion 88H are different from the filter portion 88A, the swing calculator portion 88B, the signal judgment portion 88C, the control signal generator portion 88D in that the operation signal is a signal output from the detector sensor 63 and the control signal is a signal output to each of the multiple control valves 59. With respect to the other configurations, the filter portion 88E, the swing calculator portion 88F, the signal judgment portion 88G and the control signal generator portion 88H are the same as the filter portion 88A, the swing calculator portion 88B, the signal judgment portion 88C and the control signal generator portion 88D.

That is, in the description of the filter portion 88A, the swing calculator portion 88B, the signal judgment section 88C, and the control signal generator portion 88D described above, each of the traveling operation member 51 and the plurality of operation valves 55 (the operation valves 55A, 55B, 55C, and 55D) is read as a working operation member 62 and the plurality of operation valves 59 (the operation valves 59A, 59B, 59C, and 59D), which provide the description of the filter portion 88E, the swing calculator portion 88F, the signal judgment section 88G, and the control signal generator portion 88H.

The working machine for the working machine includes the hydraulic device, the operation valves 55 and 59 to supply operation fluid to operate the hydraulic device and to vary the operation fluid to be supplied to the hydraulic device, the operation devices 54 and 58 having an operation member (the traveling operation member 51 and the working operation member 62) supported swingably, the operation devices being configured to output an operation signal in accordance with an operation amount of the operation member (the traveling operation member 51 and the working operation member 62), the controller device 88 including the control signal generators 88D and 88H to generate a control signal to control the operation valves 55 and 59 based on the operation signal, the swing calculator 88B and 88F to calculate an evaluation value representing a degree of swinging of the operation member (the traveling operation member 51 and the working operation member 62) based on the operation signal, the filter to remove a predetermined frequency component from either the operation signal or the control signal, and the signal judgment analyzer 88C and 88G to judge whether to allow the filter to remove the predetermined frequency component from either the operation signal or the control signal based on the evaluation value calculated by the swing calculators 88B and 88F.

According to this configuration, the predetermined frequency of the operation and control signals can be removed or not removed depending on the evaluation value W1, which is the degree of swinging of the traveling operation member 51 and the working operation member 62. This allows the hydraulic device to be easily operated as intended by the operator.

For example, when the operator momentarily operates each of the traveling operation member 51 and the working operation member 62, the removal of either the operation signal or the control signal shall not be performed. When the traveling operation member 51 and the working operation member 62 are swayed by the traveling or work of the working machine 1 (various tasks themselves, such as ground conditions, characteristics of the working machine, and the like), regardless of the intention of the operator, either the operation signal or the control signal shall be removed. This will prevent hunting and jerking in response to swaying due to traveling and work.

In other words, the control signal can be changed according to the case where the operator grasps the operation member (traveling operation member 51 and work operation member 62) and the operation member is shaken by the traveling or traveling of the working machine 1, or where the operator intentionally operates the operation member.

The swing calculator portions 88B and 88F increase the evaluation value W1 when the operation signal is inflected within a predetermined time, and decrease the evaluation value when the operation signal is not inflected within a predetermined time.

According to this configuration, the condition of the traveling operation member 51 and the working operation member 62 being shaken by the vibration and other factors of the working machine 1 can be ascertained by the evaluation value W1.

The swing calculator portions 88B and 88F increase the evaluation value W1 when the operation signal passes the neutral signal value corresponding to the neutral position within a predetermined time, and do not increase the evaluation value when the operation signal does not pass the neutral signal value within a predetermined time.

According to this configuration, the condition of the traveling operation member 51 and the working operation member 62, which are swung by the vibration or other factors of the working machine 1 across the neutral position, can be ascertained by the evaluation value W1.

The swing calculator portions 88B and 88F change the frequency at which the removal is performed. According to this configuration, the operation signal can be cut off in response to the swaying of the working machine 1.

The swing calculator portions 88B and 88F decrease the cut-off frequency as the evaluation value W1 increases. According to this configuration, when the degree of swinging of the working machine 1 is large, the operating signal, which is convolved with disturbance due to the vibration of the working machine 1 and the like, can be corrected to a proper signal.

The hydraulic device includes a traveling pump (left traveling pump 53L, right traveling pump 53R) that can change the flow rate of the hydraulic fluid output according to the pressure of the hydraulic fluid set by the operation valves 55 and 59, and the traveling motor (left traveling motor 36L, right traveling motor 36R) that operates according to the flow rate of the hydraulic fluid output by the traveling pump (left traveling pump 53L, right traveling pump 53R).

According to this configuration, the operator's intended operation can be carried out when the driving operation member 51 is operated by the driving system (traveling pump and traveling motor).

The hydraulic device includes the boom cylinder 14 to actuate the boom 10, the working tool cylinder 15 to actuate the working tool mounted on the end of the boom 10, the boom control valve 56A to control the hydraulic fluid supplied to the boom cylinder 14 according to the pressure of the hydraulic fluid set by the operation valves 55 and 59, and the working tool control valve 56B to control the hydraulic fluid supplied to the working tool cylinder 15 according to the pressure of the hydraulic fluid set by the operation valves 55 and 59.

This allows the operator to operate the working operation device 62 to raise and lower the boom 10 or operate the working machine as intended by the operator.

In the above-described embodiment, a predetermined frequency component of either the operation signal or the control signal is removed when the evaluation value W1 is greater than or equal to the threshold Q1. However, in addition to this, when either the operation signal or the control signal is a signal of the traveling system, that is, when the operation signal (traveling operation signal) or the control signal of the traveling system when the traveling operation member 51 is operated (traveling operation signal) or the control signal of the traveling system, the signal judgment portions 88C and 88G may determine that the predetermined frequency is removed. When either the operation signal or the control signal is a signal of the work system, for example, a working operation signal to operate the bucket 11, the signal judgment portions 88C and 88G may determine that the predetermined frequency is not removed.

In this manner, when turning the working machine 1, the operation can be performed in response to the vibration of the working machine 1, and when operating the bucket 11, the bucket 11 can be finely manipulated in response to the operator's operation.

The signal judgment portion 88G may determine that a predetermined frequency is removed when the evaluation value W1 is greater than or equal to the threshold value Q1 and the working operation signal is a working operation signal to operate the boom 10. In this manner, in the case of turning the working machine 1, the operation can be performed in response to the vibration of the working machine 1, and in the case of operating the bucket 11, the bucket 11 can be finely operated in response to the operation of the operator.

In other words, the signal judgment portions 88C and 88G determine that the signal to be removed is removed when the evaluation value W1 is greater than or equal to the threshold value Q1 and the working operation signal is a predetermined operation signal (the signal to be removed). When the working operation signal is not a signal to be removed, the signal judgment portions 88C and 88G may determine that the signal to be removed is not removed. According to this configuration, depending on the type of working, the operation can be performed in response to the vibration of the working machine 1, and furthermore, the operation can be performed in response to the operation of the operator.

The operation valves 55 and 59 may be valves that control the hydraulic fluid of the hydraulic device, that is, valves that control the flow rate of the hydraulic fluid flowing to the hydraulic device or the pressure of the hydraulic fluid.

As shown in FIG. 3B, when the evaluation value W1 is increased or decreased, the threshold may be set within a predetermined range, that is, the dead zone Q1 to Q1'. The signal judgment portion 88G retains the state of the evaluation value W1 when the evaluation value W1 enters the dead zone Q1 to Q1' (the previous state).

For example, when the evaluation value W1 gradually increases to enter the insensitive zone Q1 to Q1' under a situation where it is determined that no filter processing is to be performed, the signal judgment portion 88G maintains the state of no filter processing (OFF of the filter processing) and switches to the state of filter processing when the evaluation value W1 reaches or exceeds the insensitive zone Q1' (switching the filter processing from OFF to ON).

On the other hand, under the situation where it is determined that the filter processing is to be performed, when the evaluation value W1 gradually decreases to enter the dead zone Q1 to Q1', the signal judgment portion 88G retains that the filter processing is to be performed (the filter processing is ON) and switches to not performing the filter processing when the evaluation value W1 becomes less than the dead zone Q1 (the filter processing is switched from ON to OFF).

In the above-described embodiment, the traveling motor (left traveling motor 36L, right traveling motor 36R) and the operation valve 55 are separate, but the traveling motor (left traveling motor 36L, right traveling motor 36R) and the operation valve 55 may be of an integrated type, but are not limited thereto.

In the above description, the embodiment of the present invention has been explained. However, all the features of the embodiment disclosed in this application should be considered just as examples, and the embodiment does not restrict the present invention accordingly. A scope of the present invention is shown not in the above-described embodiment but in claims, and is intended to include all modifications within and equivalent to a scope of the claims.

What is claimed is:

1. A working machine comprising:

a hydraulic device;

an operation valve to supply operation fluid to operate the hydraulic device and to vary the operation fluid to be supplied to the hydraulic device;

an operation device having an operation member supported swingably, the operation device being configured to output an operation signal in accordance with an operation amount of the operation member; and a controller including:

a swing calculator to calculate an evaluation value representing a degree of swinging of the operation member; and a control signal generator to generate a control signal based on the evaluation value and the operation signal, wherein the swing calculator increases the evaluation value when the operation signal passes a neutral signal value corresponding to a neutral position within a predetermined time, and does not increase the evaluation value when the operation signal does not pass the neutral signal value within the predetermined time.

2. The working machine according to claim 1, wherein the control signal generator decreases a value of the control signal with respect to the operation signal as the evaluation value increases.

3. The working machine according to claim 1, wherein the control signal generator increases a value of the control signal with respect to the operation signal as the evaluation value decreases.

4. A working machine comprising:

a hydraulic device;

an operation valve to supply operation fluid to operate the hydraulic device and to vary the operation fluid to be supplied to the hydraulic device;

an operation device having an operation member supported swingably, the operation device being configured to output an operation signal in accordance with an operation amount of the operation member; and a controller including:

a swing calculator to calculate an evaluation value representing a degree of swinging of the operation member; and a control signal generator to generate a control signal based on the evaluation value and the operation signal, wherein the swing calculator increases the evaluation value when the operation signal is distorted within a predetermined time, and decreases the evaluation value when the operation signal is not distorted within the predetermined time.

5. The working machine according to claim 4, wherein the control signal generator decreases a value of the control signal with respect to the operation signal as the evaluation value increases.

6. The working machine according to claim 4, wherein the control signal generator increases a value of the control signal with respect to the operation signal as the evaluation value decreases.

7. A working machine comprising:

a hydraulic device;

an operation valve to supply operation fluid to operate the hydraulic device and to vary the operation fluid to be supplied to the hydraulic device;

an operation device having an operation member supported swingably, the operation device being configured to output an operation signal in accordance with an operation amount of the operation member; and a controller including:

a swing calculator to calculate an evaluation value representing a degree of swinging of the operation member; and a control signal generator to generate a control signal based on the evaluation value and the operation signal, wherein the control signal generator increases a value of the control signal with respect to the operation signal as the evaluation value decreases.

8. A working machine comprising:

a hydraulic device;

an operation valve to supply operation fluid to operate the hydraulic device and to vary the operation fluid to be supplied to the hydraulic device;

an operation device having an operation member supported swingably, the operation device being configured to output an operation signal in accordance with an operation amount of the operation member;

a controller including:

a control signal generator to generate a control signal to control the operation valve based on the operation signal;

a swing calculator to calculate an evaluation value representing a degree of swinging of the operation member based on the operation signal;

a filter to remove a predetermined frequency component from either the operation signal or the control signal; and a signal judgment analyzer to judge whether to allow the filter to remove the predetermined frequency component from either the operation signal or the control signal based on the evaluation value calculated by the swing calculator.

9. The working machine according to claim 8, wherein the swing calculator increases the evaluation value when the operation signal is distorted within a predetermined time, and decreases the evaluation value when the operation signal is not distorted within the predetermined time.

10. The working machine according to claim 9, wherein the swing calculator changes a frequency to be removed.

11. The working machine according to claim 8, wherein the swing calculator increases the evaluation value when the operation signal passes a neutral signal value corresponding to a neutral position within a predetermined time, and does not increase the evaluation value when the operation signal does not pass the neutral signal value within the predetermined time.

12. The working machine according to claim 11, wherein the swing calculator changes a frequency to be removed.

13. The working machine according to claim 8, wherein the swing calculator changes a frequency to be removed.

14. The working machine according to claim 13, wherein the swing calculator lowers a cutoff frequency as the evaluation value increases.

15. The working machine according to claim 8, wherein the hydraulic device includes:

a traveling pump to change a flow rate of operation fluid to be outputted in accordance with a pressure of the operation fluid set by the operation valve; and a traveling motor to be activated in accordance with the flow rate of operation fluid outputted by the traveling pump.

16. The working machine according to claim 8, wherein the hydraulic device includes:

a boom cylinder to operate a boom;

a working tool cylinder to operate a working tool attached to a tip portion of the boom;

a boom control valve to control operation fluid to be supplied to the boom cylinder in accordance with a pressure of the operation fluid set by the operation valve; and a working tool control valve to control operation fluid to be supplied to the working tool cylinder in accordance with a pressure of the operation fluid set by the operation valve.

17. A working machine comprising:

a hydraulic device;

an operation valve to supply operation fluid to operate the hydraulic device and to vary the operation fluid to be supplied to the hydraulic device;

an operation device having an operation member supported swingably, the operation device being configured to output an operation signal in accordance with an operation amount of the operation member; and a controller including:

a swing calculator to calculate an evaluation value representing a degree of swinging of the operation member; and a control signal generator to generate a control signal based on the evaluation value and the operation signal, wherein the hydraulic device includes:

a traveling pump to change a flow rate of operation fluid to be outputted in accordance with a pressure of the operation fluid set by the operation valve; and a traveling motor to be activated in accordance with the flow rate of operation fluid outputted by the traveling pump.

18. A working machine comprising:

a hydraulic device;

an operation valve to supply operation fluid to operate the hydraulic device and to vary the operation fluid to be supplied to the hydraulic device;

an operation device having an operation member supported swingably, the operation device being configured to output an operation signal in accordance with an operation amount of the operation member; and a controller including:

a swing calculator to calculate an evaluation value representing a degree of swinging of the operation member; and a control signal generator to generate a control signal based on the evaluation value and the operation signal, wherein the hydraulic device includes:

a boom cylinder to operate a boom;

a working tool cylinder to operate a working tool attached to a tip portion of the boom;

a boom control valve to control operation fluid to be supplied to the boom cylinder in accordance with a pressure of the operation fluid set by the operation valve; and a working tool control valve to control operation fluid to be supplied to the working tool cylinder in accordance with a pressure of the operation fluid set by the operation valve.

* * * * *